US011472680B2

(12) United States Patent
Kawabuchi et al.

(10) Patent No.: US 11,472,680 B2
(45) Date of Patent: Oct. 18, 2022

(54) CRANE

(71) Applicant: TADANO LTD., Kagawa (JP)

(72) Inventors: Naoto Kawabuchi, Kagawa (JP); Hisanori Wada, Kagawa (JP); Naotaka Masuda, Lauf a.d. Pegnitz (DE)

(73) Assignee: TADANO LTD., Kagawa (JP)

( * ) Notice: Subject to any disclaimer, the term of this patent is extended or adjusted under 35 U.S.C. 154(b) by 145 days.

(21) Appl. No.: 17/056,899

(22) PCT Filed: May 27, 2019

(86) PCT No.: PCT/JP2019/020924
§ 371 (c)(1),
(2) Date: Nov. 19, 2020

(87) PCT Pub. No.: WO2019/230656
PCT Pub. Date: Dec. 5, 2019

(65) Prior Publication Data

US 2021/0292137 A1 Sep. 23, 2021

(30) Foreign Application Priority Data

May 31, 2018 (JP) ..... JP2018-105170

(51) Int. Cl.
*B66C 23/70* (2006.01)
*B66C 23/00* (2006.01)
*B66C 23/42* (2006.01)

(52) U.S. Cl.
CPC ..... *B66C 23/705* (2013.01); *B66C 23/54* (2013.01); *B66C 23/42* (2013.01)

(58) Field of Classification Search
CPC ..... B66C 23/42; B66C 23/54; B66C 23/701; B66C 23/705; B66C 23/706; B66C 23/707; B66C 23/708
See application file for complete search history.

(56) References Cited

U.S. PATENT DOCUMENTS 4,433,515 A * 2/1984 Mentzer ..... B66C 23/708 212/292
2007/0289436 A1* 12/2007 Errani ..... B66C 23/705 91/6

(Continued)

FOREIGN PATENT DOCUMENTS

CN 101723262 A 6/2010
CN 103438034 A 12/2013

(Continued)

OTHER PUBLICATIONS

Espacenet.com, Translation of CN103438034A, Jun. 2022 (Year: 2022).*

(Continued)

*Primary Examiner* — Sang K Kim
*Assistant Examiner* — Nathaniel L Adams
(74) *Attorney, Agent, or Firm* — Paratus Law Group, PLLC

(57) ABSTRACT

This crane is provided with: a telescopic boom that can be extended; an extension device for extending the telescopic boom; a hydraulic pressure source provided in the extension device; a cylinder connection mechanism connected to the hydraulic pressure source and switching between the states of connection and non-connection with the telescopic boom on the basis of the supply and discharge of hydraulic oil; a first oil path for connecting the hydraulic pressure source and the cylinder connection mechanism; a first valve that is provided on the first oil path and switches the supply and discharge state of the hydraulic oil with respect to the cylinder connection mechanism; and a second oil path that bypasses the first valve and connects the hydraulic pressure source and the cylinder connection mechanism.

8 Claims, 11 Drawing Sheets

(56) References Cited

U.S. PATENT DOCUMENTS

| | | | | |
|---|---|---|---|---|
| 2015/0060385 | A1* | 3/2015 | Matsuda | B66C 23/705 212/349 |
| 2015/0144583 | A1* | 5/2015 | Matsumoto | B66C 23/705 212/276 |
| 2017/0088402 | A1* | 3/2017 | Ikeda | B66C 23/705 |

FOREIGN PATENT DOCUMENTS

| | | | |
|---|---|---|---|
| CN | 104591012 | A | 5/2015 |
| CN | 106365055 | A | 2/2017 |
| JP | 2012-096928 | A | 5/2012 |

OTHER PUBLICATIONS

Jul. 23, 2019, International Search Report issued for related PCT application No. PCT/JP2019/020924.
Jul. 23, 2019, International Search Opnion issued for related PCT application No. PCT/JP2019/020924.

* cited by examiner

CRANE

CROSS REFERENCE TO PRIOR APPLICATION

This application is a National Stage Patent Application of PCT International Patent Application No. PCT/JP2019/020924 (filed on May 27, 2019) under 35 U.S.C. § 371, which claims priority to Japanese Patent Application No. 2018-105170 (filed on May 31, 2018), which are all hereby incorporated by reference in their entirety.

TECHNICAL FIELD

The present invention relates to a crane with a telescopic boom.

BACKGROUND ART

Patent Literature 1 discloses a telescopic boom including a plurality of boom elements in a nested structure (also referred to as a telescopic structure), and a mobile crane including a hydraulic telescopic cylinder for extending the telescopic boom.

The telescopic boom includes boom connection pins that connect adjacent and overlapping boom elements. The boom element connection of which by the boom connection pins (hereinafter referred to as the displaceable boom element) has been released becomes displaceable in a longitudinal direction (also referred to as an extension/contraction direction) with respect to another boom element.

The telescopic cylinder includes a rod member and a cylinder member. Such a telescopic cylinder has the cylinder member connected to the displaceable boom element using cylinder connection pins. Displacement of the cylinder member in the extension/contraction direction in this state leads to the displacement of the displaceable boom element together with the cylinder member, resulting in extension/contraction of the telescopic boom.

CITATION LIST

Patent Literature

Patent Literature 1: JP 2012-96928 A

SUMMARY OF THE INVENTION

Problems to be Solved by the Invention

The crane as described above includes a hydraulic actuator that displaces the cylinder connection pins and a hydraulic circuit that supplies pressure oil to the actuator. Such a hydraulic circuit includes a valve for switching between supply and discharge of hydraulic oil to and from the actuator. If such a valve becomes inoperable, the actuator cannot be operated.

An object of the present invention is to provide a crane in which an actuator that displaces cylinder connection pins can be operated even when a valve that switches between supply and discharge of hydraulic oil to and from the actuator becomes inoperable.

Solutions to Problems

A crane according to the present invention includes: a telescopic boom that can be extended; an extension device for extending the telescopic boom; a hydraulic pressure source provided in the extension device; a cylinder connection mechanism connected to the hydraulic pressure source and switching between the states of connection and non-connection with the telescopic boom on the basis of the supply and discharge of hydraulic oil; a first oil path for connecting the hydraulic pressure source and the cylinder connection mechanism; a first valve that is provided on the first oil path and switches the supply and discharge state of the hydraulic oil with respect to the cylinder connection mechanism; and a second oil path that bypasses the first valve and connects the hydraulic pressure source and the cylinder connection mechanism.

Effects of the Invention

The present invention can provide a crane in which an actuator that displaces cylinder connection pins can be operated even when a valve becomes inoperable.

DESCRIPTION OF EMBODIMENTS

Some examples of embodiments according to the present invention are described in detail below with reference to the drawings. It should be noted that each embodiment described below is an example of a crane according to the present invention, and the present invention is not limited to each embodiment.

First Embodiment

Figure 1:
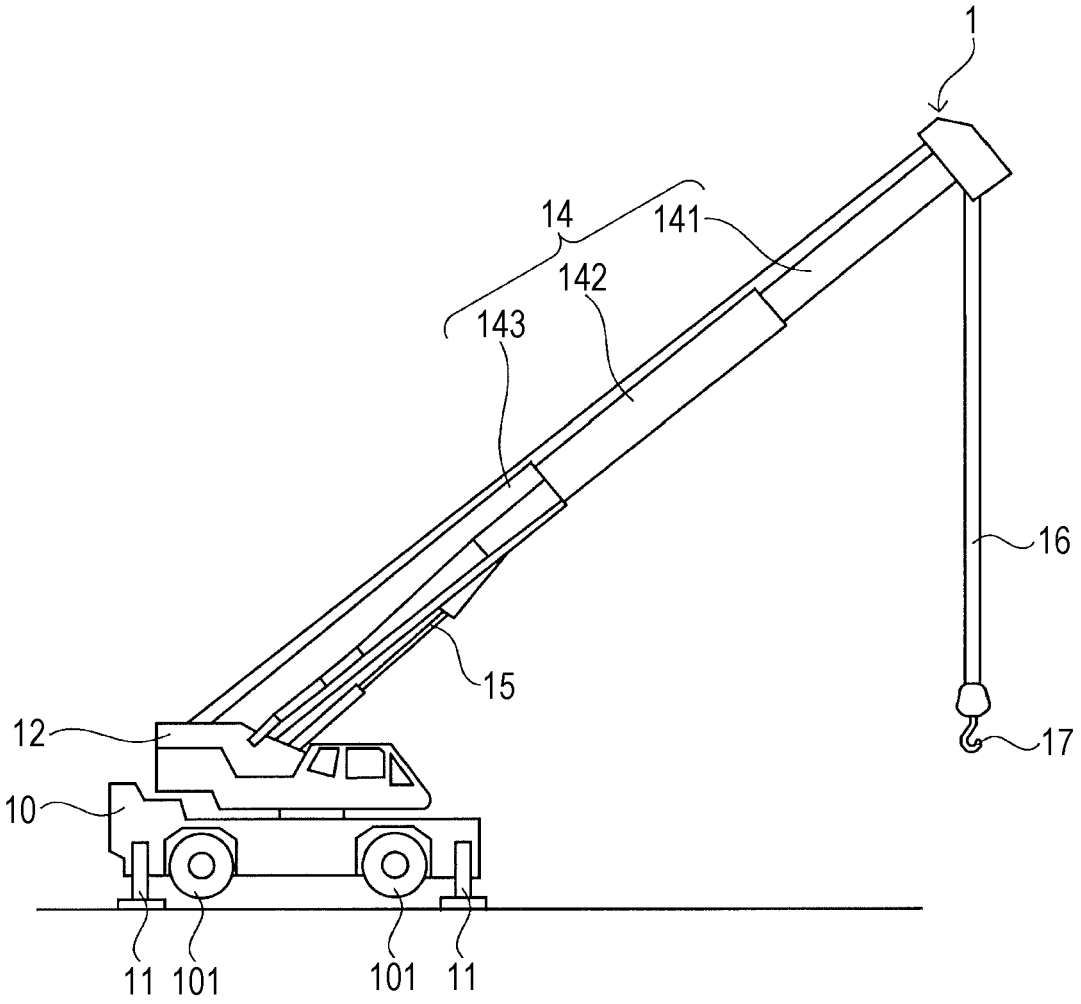
FIG. 1 is a schematic view of a crane according to a first embodiment of the present invention.

FIG. 1 is a schematic view of a mobile crane 1 (rough terrain crane in the illustrated case) according to the present embodiment.

Examples of the mobile crane include an all-terrain crane, a truck cranes, and a truck loader crane (also referred to as a cargo crane). However, the crane according to the present invention is not limited to a mobile crane, and can be applied to other cranes having a telescopic boom.

Hereinafter, first of all, the mobile crane 1 and a telescopic boom 14 of the mobile crane 1 will be described. Then, the description will be given on the specific structure and operation of a hydraulic mechanism 6 (see FIG. 3A) for operating a cylinder connection mechanism 4 and a boom connection mechanism 5, which are the features of the mobile crane 1 according to the present embodiment.

[Mobile Crane]

The mobile crane 1 illustrated in FIG. 1 includes a traveling body 10, outriggers 11, a swivel base 12, the telescopic boom 14, an actuator A (see FIGS. 2A to 2E), a derricking cylinder 15, a wire rope 16, and a hook 17.

The traveling body 10 has a plurality of wheels 101. The outriggers 11 are provided at the four corners of the traveling body 10. The swivel base 12 is provided on an upper portion of the traveling body 10 so as to be swivelable. The telescopic boom 14 has a base end portion fixed to the swivel base 12. The actuator A extends and contracts the telescopic boom 14. The derricking cylinder 15 moves the telescopic boom 14 upward and downward. The wire rope 16 hangs from a distal end portion of the telescopic boom 14. The hook 17 is provided at the distal end of the wire rope 16.

[Telescopic Boom]

Next, the telescopic boom 14 will be described with reference to FIGS. 1 and 2A to 2E. FIGS. 2A to 2E are schematic views for explaining the structure and extension/contraction operation of the telescopic boom 14.

FIG. 1 illustrates the telescopic boom 14 in an extension state. FIG. 2A illustrates the telescopic boom 14 in a contraction state. FIG. 2E illustrates the telescopic boom 14 in which only a distal end boom element 141, which will be described later, is extended.

The telescopic boom 14 includes a plurality (at least a pair) of boom elements. The plurality of boom elements each have a tubular shape and are telescopically combined. Specifically, in the contraction state, the plurality of boom elements have the distal end boom element 141, an intermediate boom element 142, and a base end boom element 143 in this order from the inner side.

In the case of the present embodiment, the distal end boom element 141 and the intermediate boom element 142 are boom elements that are displaceable in the extension/contraction direction. On the other hand, the base end boom element 143 is a boom element whose displacement in the extension/contraction direction is regulated.

The telescopic boom 14 transitions from the contraction state illustrated in FIG. 2A to the extension state illustrated in FIG. 1 by extending in order from the boom element arranged on the inner side (that is, the distal end boom element 141).

In the extension state, the intermediate boom element 142 is arranged between the base end boom element 143 on the most base end side and the distal end boom element 141 on the most distal end side. There may be a plurality of intermediate boom elements.

The telescopic boom 14 is substantially the same as the conventionally known telescopic boom, but for convenience of description of the actuator A described later, the distal end boom element 141 and the intermediate boom element 142 will be described below.

[Distal End Boom Element]

The distal end boom element 141 has a tubular shape and has an internal space that can accommodate the actuator A. The distal end boom element 141 includes a pair of cylinder pin receiving portions 141*a* and a pair of boom pin receiving portions 141*b* at the base end portion.

The pair of cylinder pin receiving portions 141*a* are formed coaxially with each other at the base end portion of the distal end boom element 141. Each of the pair of cylinder pin receiving portions 141*a* can be engaged with and disengaged from (that is, in either an engaged state or a disengaged state) a pair of cylinder connection pins 41 provided on a cylinder member 32 of a telescopic cylinder 3. The pair of cylinder connection pins 41 are each urged in a direction of engaging with the pair of cylinder pin receiving portions 141*a* by, for example, a spring (not illustrated).

Each of the pair of cylinder connection pins 41 is displaced in its own axial direction based on the operation of the cylinder connection mechanism 4 included in the actuator A. With the pair of cylinder connection pins 41 and the pair of cylinder pin receiving portions 141*a* engaged, the distal end boom element 141 is displaceable in the extension/contraction direction together with the cylinder member 32.

The pair of boom pin receiving portions 141*b* are formed coaxially with each other closer to the base end in the distal end boom element 141 than the cylinder pin receiving portions 141*a* are. The pair of boom pin receiving portions 141*b* can be engaged with and detached from a pair of boom connection pins 51*a*.

The pair of boom connection pins 51*a* each connect the distal end boom element 141 and the intermediate boom element 142. Each of the pair of boom connection pins 51*a* is displaced in its own axial direction based on the operation of the boom connection mechanism 5 included in the actuator A.

With the distal end boom element 141 and the intermediate boom element 142 connected by the pair of boom connection pins 51*a*, the boom connection pins 51*a* are inserted across the boom pin receiving portions 141*b* of the distal end boom element 141 and first boom pin receiving portions 142*b* or second boom pin receiving portions 142*c* of the intermediate boom element 142 described later. The pair of boom connection pins 51*a* are each urged in a direction of engaging with the first boom pin receiving portions 142*b* by, for example, a spring (not illustrated).

With the distal end boom element 141 and the intermediate boom element 142 connected (also referred to as a state of connection), the distal end boom element 141 cannot be displaced with respect to the intermediate boom element 142 in the extension/contraction direction.

On the other hand, with the distal end boom element 141 and the intermediate boom element 142 disconnected (also referred to as a state of non-connection), the distal end boom element 141 is displaceable with respect to the intermediate boom element 142 in the extension/contraction direction.

[Intermediate Boom Element]

The intermediate boom element 142 has a tubular shape as illustrated in FIGS. 2A to 2E, and has an internal space that can accommodate the distal end boom element 141. The intermediate boom element 142 includes a pair of cylinder pin receiving portions 142*a*, the pair of first boom pin receiving portions 142*b*, and a pair of third boom pin receiving portions 142*d* at the base end portion.

The pair of cylinder pin receiving portions 142*a* and the pair of first boom pin receiving portions 142*b* are substantially the same as the pair of cylinder pin receiving portions 141*a* and the pair of boom pin receiving portions 141*b* of the distal end boom element 141, respectively.

The pair of third boom pin receiving portions 142*d* are formed coaxially with each other closer to the base end in the intermediate boom element 142 than the pair of first boom pin receiving portions 142*b* are. Boom connection pins 51*b* can be inserted into the pair of respective third boom pin receiving portions 142*d*. The boom connection pins 51*b* connect the intermediate boom element 142 and the base end boom element 143. The pair of boom connection pins 51*b* are each urged in a direction of engaging with the first boom pin receiving portions 142*b* by, for example, a spring (not illustrated).

Furthermore, the intermediate boom element 142 includes the pair of second boom pin receiving portions 142*c* at the distal end portion. The pair of second boom pin receiving portions 142*c* are formed coaxially with each other at the distal end portion of the intermediate boom element 142. The pair of boom connection pins 51*a* can be inserted into each of the pair of respective second boom pin receiving portions 142*c*.

[Actuator]

The actuator A as described above extends and contracts the telescopic boom 14 (see FIGS. 1, 2A to 2E). The actuator A includes, for example, the telescopic cylinder 3 (also referred to as an extension device) that displaces the distal end boom element 141 among the adjacent and overlapping distal end boom element 141 (also referred to as an inner boom element) and intermediate boom element 142 (also referred to as an outer boom element) in the extension/contraction direction, an accumulator 602A (also referred to as a hydraulic pressure source, see FIGS. 3A to 3E) provided in the telescopic cylinder 3, the cylinder connection mechanism 4 (see FIGS. 3A to 3E) that switches between states of connection and non-connection between the telescopic cylinder 3 and the distal end boom element 141 by displacing the pair of cylinder connection pins 41 based on the supply and discharge of hydraulic oil, and the boom connection mechanism 5 (see FIGS. 3A to 3E) that switches between states of connection and non-connection between the distal end boom element 141 and the intermediate boom element 142 by displacing the pair of boom connection pins 51*a* based on the supply and discharge of hydraulic oil.

[Telescopic Cylinder]

The telescopic cylinder 3 includes a rod member 31 (also referred to as a fixed side member, see FIGS. 2A to 2E) and the cylinder member 32 (also referred to as a movable side member). This telescopic cylinder 3 displaces a boom element (for example, the distal end boom element 141 or the intermediate boom element 142) connected to the cylinder member 32 via the cylinder connection pins 41 described later in the extension/contraction direction.

Figure 3A:
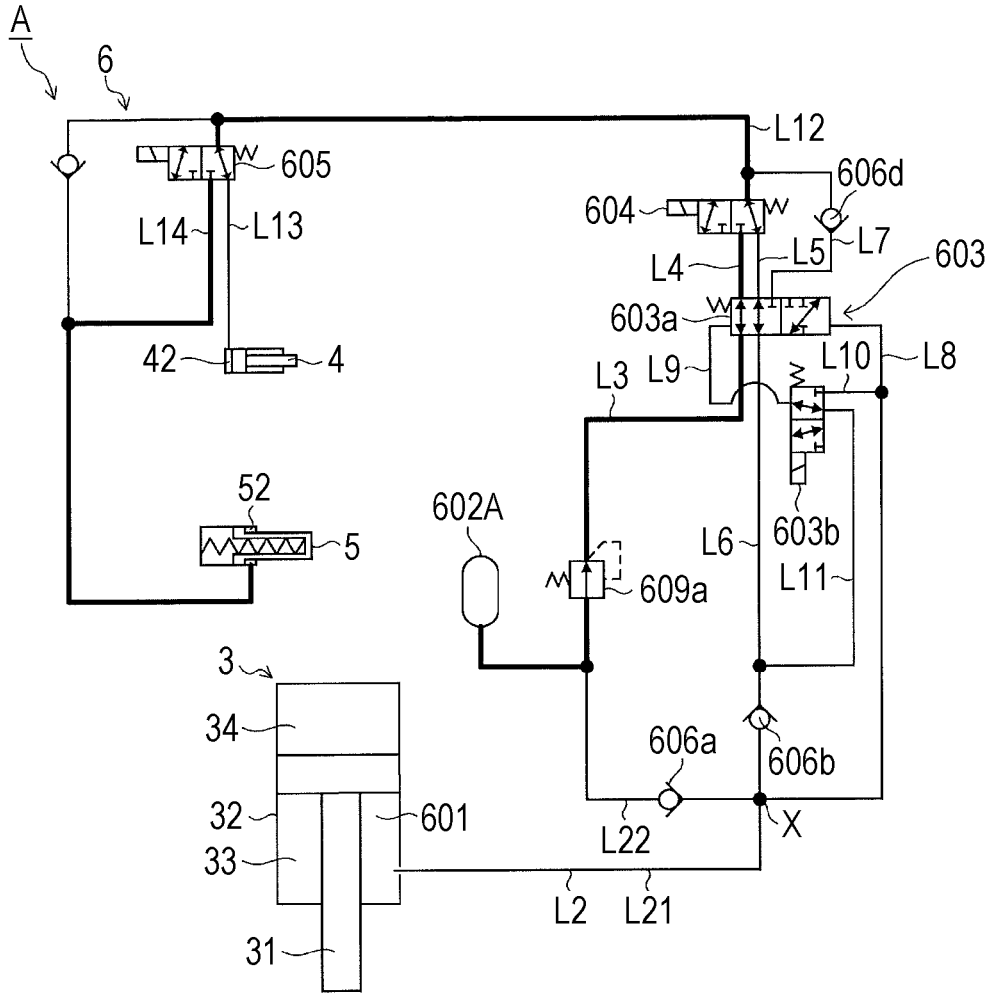
FIG. 3A is a diagram illustrating a state of a hydraulic circuit when a boom connection mechanism is transitioned to a disengaged state in the crane according to the first embodiment.

As illustrated in FIG. 3A, this telescopic cylinder 3 includes a contraction side hydraulic chamber 33 and an extension side hydraulic chamber 34 in the internal space of the cylinder member 32. The contraction side hydraulic chamber 33 and the extension side hydraulic chamber 34 are each connected to a hydraulic pump (not illustrated) that is driven based on the driving force of an engine (not illustrated). When hydraulic oil is supplied from the hydraulic pump to the extension side hydraulic chamber 34, the telescopic cylinder 3 extends. When hydraulic oil is supplied from the hydraulic pump to the contraction side hydraulic chamber 33, the telescopic cylinder 3 contracts. Since the structure of the telescopic cylinder 3 is almost the same as that of a conventionally known telescopic cylinder, any further detailed description thereof will be omitted.

[Cylinder Connection Mechanism]

The cylinder connection mechanism 4 transitions between an extension state and a contraction state based on the supply and discharge of hydraulic oil to the hydraulic chamber 42 (see FIG. 3A). Specifically, the cylinder connection mechanism 4 is in the contraction state when hydraulic oil is supplied to the hydraulic chamber 42. On the other hand, the cylinder connection mechanism 4 is in the extension state when hydraulic oil is discharged from the hydraulic chamber 42.

In the extension state of the cylinder connection mechanism 4, the pair of cylinder connection pins 41 and the pair of cylinder pin receiving portions 141*a* of the boom element (for example, the distal end boom element 141) are in an engaged state (also referred to as a cylinder pin engaged state). In the engaged state, the boom element and the cylinder member 32 are in the state of connection.

On the other hand, in the contraction state of the cylinder connection mechanism 4, the pair of cylinder connection pins 41 and the pair of cylinder pin receiving portions 141*a* (see FIGS. 2A to 2E) are in a disengaged state (the state illustrated in FIG. 2E, and also referred to as a cylinder pin disengaged state). In the disengaged state, the boom element and the cylinder member 32 are in the state of non-connection.

In the following description, the operation when the cylinder connection mechanism 4 transitions from the extension state to the contraction state is referred to as a disengaging operation of the cylinder connection mechanism 4. The cylinder connection mechanism 4 displaces the pair of cylinder connection pins 41 against the elastic force of a spring (not illustrated) in the disengaging operation. Furthermore, the operation when the cylinder connection mechanism 4 transitions from the contraction state to the extension state is referred to as an engaging operation of the cylinder connection mechanism 4. Since the structure of this cylinder connection mechanism 4 is the same as that of a conventionally known structure, any further detailed description thereof will be omitted.

[Boom Connection Mechanism]

The boom connection mechanism 5 transitions between the extension state and the contraction state based on the supply and discharge of hydraulic oil to the hydraulic chamber 52 (see FIG. 3A). Specifically, the boom connection mechanism 5 is in the contraction state when hydraulic oil is supplied to the hydraulic chamber 52. On the other hand, the boom connection mechanism 5 is in the extension state when hydraulic oil is discharged from the hydraulic chamber 52.

In the extension state, the boom connection mechanism 5 takes either an engaged state with or a disengaged state from boom connection pins (for example, the pair of boom connection pins 51*a*).

Figure 2C:
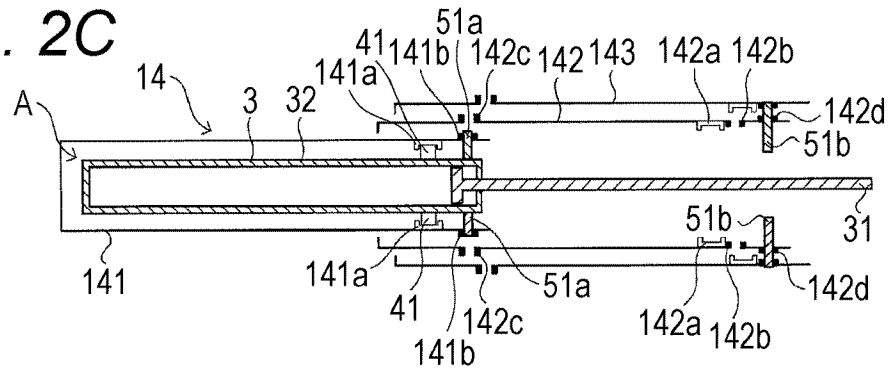
FIGS. 2A to 2E are schematic views for explaining the structure and extension/contraction operation of a telescopic boom.
Figure 2D:
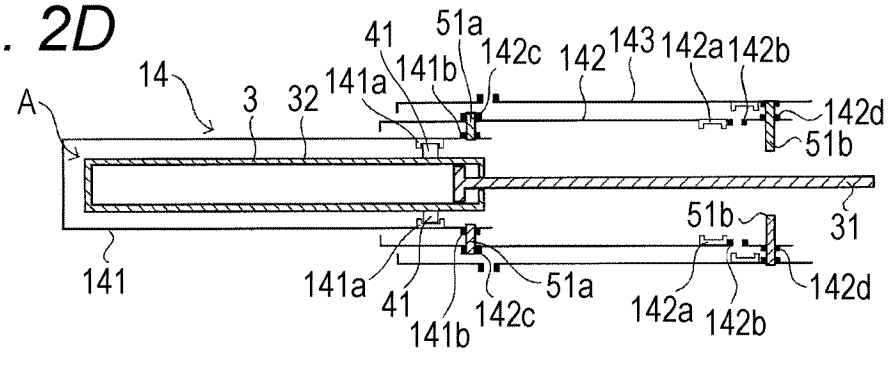
Figure 2E:
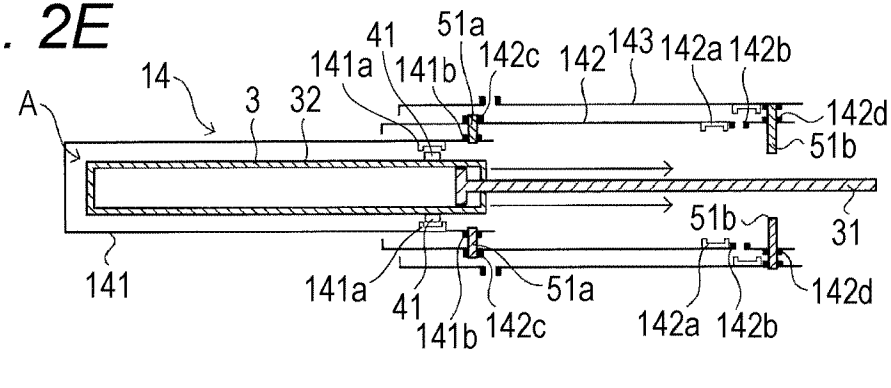
Figure 2A:
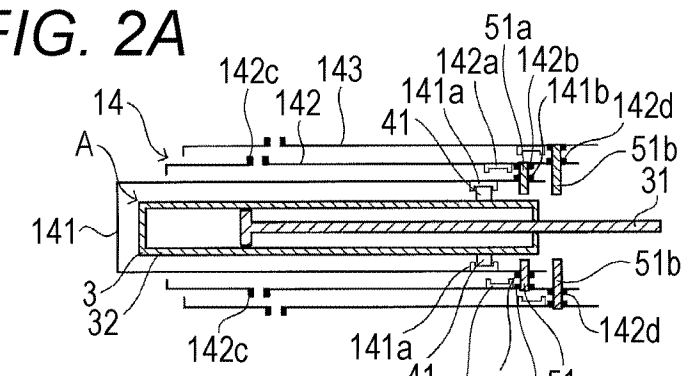
Figure 2B:
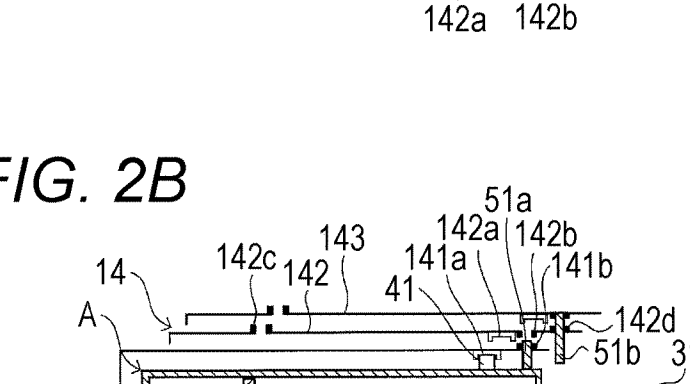

The boom connection mechanism 5 disengages boom connection pins (for example, the pair of boom connection pins 51*a*) from a boom element (for example, the first boom pin receiving portions 142*b* of the intermediate boom element 142) by transitioning from the extension state to the contraction state while being engaged with the boom connection pins (see FIGS. 2A and 2B).

Furthermore, the boom connection mechanism 5 engages the boom connection pins with the boom element by transitioning from the contraction state to the extension state while being engaged with the boom connection pins.

In the following description, the operation when the boom connection mechanism 5 transitions from the extension state to the contraction state is referred to as a disengaging operation of the boom connection mechanism. The boom connection mechanism 5 displaces the pair of boom connection pins 51*a* or the pair of boom connection pins 51*b* against the elastic force of a spring (not illustrated) in the disengaging operation. Furthermore, the operation when the boom connection mechanism 5 transitions from the contraction state to the extension state is referred to as an engaging operation of the boom connection mechanism. Since the structure of this boom connection mechanism 5 is the same as that of a conventionally known structure, any further detailed description thereof will be omitted.

[Hydraulic Mechanism]

Next, the hydraulic mechanism 6 for driving the cylinder connection mechanism 4 and the boom connection mechanism 5 will be described with reference to FIGS. 3A to 3E.

The hydraulic mechanism 6 includes a cylinder side hydraulic pressure source 601, the accumulator 602A, a hydraulic pressure switching mechanism 603, a first solenoid valve 604, and a second solenoid valve 605. This hydraulic mechanism 6 is provided in the telescopic cylinder 3 (specifically, the cylinder member 32; see FIGS. 2A to 2E for the cylinder member 32). Therefore, the hydraulic mechanism 6 is displaceable together with the cylinder member 32.

These configurations are connected through individual oil paths described later. In particular, in the case of the present embodiment, the hydraulic mechanism 6 includes a normal oil path that is an oil path for hydraulic oil in a normal time and an emergency oil path that is an oil path for hydraulic oil in an emergency. The normal oil path is an oil path through which hydraulic oil flows in the cases of operation examples 1-1 to operation examples 1-4, which will be described later. The emergency oil path is an oil path through which hydraulic oil flows in the case of operation example 1-5, which will be described later. The normal oil path and the emergency oil path will be described later.

[Cylinder Side Hydraulic Pressure Source]

The cylinder side hydraulic pressure source 601 is composed of a contraction side hydraulic chamber 33 in the cylinder member 32 of the telescopic cylinder 3.

[Accumulator]

The accumulator 602A is a hydraulic pressure source that boosts and stores hydraulic oil supplied from the cylinder side hydraulic pressure source 601.

The cylinder side hydraulic pressure source 601 and the accumulator 602A are connected through an oil path element L2. In the following description, the upstream side means the side closer to the hydraulic pressure source (the cylinder side hydraulic pressure source 601 or the accumulator 602A) in the oil path for hydraulic oil unless otherwise specified. The downstream side means the side closer to the cylinder connection mechanism 4 or the boom connection mechanism 5 in the oil path for hydraulic oil unless otherwise specified. In the following description, the upstream end of each oil path element may be replaced with one end, and the downstream end thereof may be replaced with the other end.

The oil path element L2 includes an upstream oil path element L21 on the upstream side (the side closer to the cylinder side hydraulic pressure source 601) of a branch point X, and a downstream oil path element L22 on the downstream side (the side away from the cylinder side hydraulic pressure source 601) of the branch point X. The downstream end of the downstream oil path element L22 is connected to an input port of the accumulator 602A. The upstream oil path element L22 is provided with a check valve 606*a*. The configuration of the oil path element L2 is not limited to the one illustrated in the figure.

[Hydraulic Pressure Switching Mechanism]

The hydraulic pressure switching mechanism 603 includes a hydraulic pressure switching valve 603*a* and a pilot solenoid valve 603*b*. The hydraulic pressure switching mechanism 603 is for supplying hydraulic oil supplied from a hydraulic pressure source (the accumulator 602A in the case of the present embodiment) to an oil path element L7 (bypass oil path), which will be described later, in an emergency.

[Hydraulic Pressure Switching Valve]

The hydraulic pressure switching valve 603*a* is a second valve. A downstream end of an oil path element L3 is connected to a first port of this hydraulic pressure switching valve 603*a*. An upstream end of the oil path element L3 is connected to an output port of the accumulator 602A. The hydraulic pressure switching valve 603*a* is connected to the accumulator 602A via the oil path element L3. The oil path element L3 is provided with a pressure reducing valve 609*a*. The configuration of the oil path element L3 is not limited to the one illustrated in the figure.

An upstream end of an oil path element L4 is connected to a second port of the hydraulic pressure switching valve 603*a*. A downstream end of the oil path element L4 is connected to the first solenoid valve 604. The hydraulic pressure switching valve 603*a* is connected to the first solenoid valve 604 via the oil path element L4. The configuration of the oil path element L4 is not limited to the one illustrated in the figure.

An upstream end of an oil path element L5 is connected to a third port of the hydraulic pressure switching valve 603*a*. A downstream end of the oil path element L5 is connected to the first solenoid valve 604. The hydraulic pressure switching valve 603*a* is connected to the first solenoid valve 604 via the oil path element L5. The configuration of the oil path element L5 is not limited to the one illustrated in the figure.

A downstream end of an oil path element L6 is connected to a fourth port of the hydraulic pressure switching valve 603*a*. An upstream end of the oil path element L6 is connected to the upstream oil path element L21 via the branch point X. The hydraulic pressure switching valve 603*a* is connected to the cylinder side hydraulic pressure source 601 via the oil path element L6 and the upstream oil path element L21. The configuration of the oil path element L6 is not limited to the one illustrated in the figure.

The oil path element L6 is provided with a check valve 606*b*. The check valve 606*b* allows the flow of hydraulic oil from the downstream side to the upstream side. On the other hand, the check valve 606*b* blocks the flow of hydraulic oil from the upstream side to the downstream side. The configuration of the oil path element L6 is not limited to the one illustrated in the figure.

An upstream end of an oil path element L7 is connected to a fifth port of the hydraulic pressure switching valve 603*a*. The oil path element L7 is a bypass oil path that bypasses the first solenoid valve 604. A downstream end of the oil path element L7 is connected to an oil path element L12 described later. The oil path element L7 is provided with a check valve 606*d*. The check valve 606*d* allows the flow of hydraulic oil from the upstream side to the downstream side. On the other hand, the check valve 606*d* blocks the flow of hydraulic oil from the downstream side to the upstream side. The configuration of the oil path element L7 is not limited to the one illustrated in the figure.

A downstream end of an oil path element L8 is connected to a sixth port of the hydraulic pressure switching valve 603*a*. An upstream end of the oil path element L8 is connected to the upstream oil path element L21 via the branch point X. The hydraulic pressure switching valve 603*a* is connected to the cylinder side hydraulic pressure source 601 via the oil path element L8 and the upstream oil path element L21. The configuration of the oil path element L8 is not limited to the one illustrated in the figure.

A downstream end of an oil path element L9 is connected to a seventh port (pilot port) of the hydraulic pressure switching valve 603*a*. An upstream end of the oil path element L9 is connected to the pilot solenoid valve 603*b*. The hydraulic pressure switching valve 603*a* is connected to the pilot solenoid valve 603*b* via the oil path element L9. The configuration of the oil path element L9 is not limited to the one illustrated in the figure.

[Pilot Solenoid Valve]

The pilot solenoid valve 603*b* (also referred to as a third valve) supplies hydraulic oil from the cylinder side hydraulic pressure source 601 to the seventh port (pilot port) of the hydraulic pressure switching valve 603*a* as a pilot pressure in an energized state. On the other hand, the pilot solenoid valve 603*b* stops supplying the hydraulic oil (pilot pressure) to the hydraulic pressure switching valve 603*a* in a non-energized state.

A downstream end of an oil path element L10 is connected to a first port of this pilot solenoid valve 603*b*. An upstream end of the oil path element L10 is connected to the oil path element L8. The configuration of the oil path element L10 is not limited to the one illustrated in the figure.

A downstream end of an oil path element L11 is connected to a second port of the pilot solenoid valve 603*b*. An upstream end of the oil path element L11 is connected to the oil path element L6. Hydraulic oil discharged from the second port of the pilot solenoid valve 603*b* returns to the cylinder side hydraulic pressure source 601 via the oil path element L11, the oil path element L6, and the upstream oil path element L21.

The upstream end of the oil path element L9 is connected to a third port of the pilot solenoid valve 603*b*. In the energized state, the pilot solenoid valve 603*b* supplies hydraulic oil supplied from the cylinder side hydraulic pressure source 601 to the hydraulic pressure switching valve 603*a* via the oil path element L9.

The hydraulic pressure switching valve 603*a* constituting the hydraulic pressure switching mechanism 603 as described above opens the second port and the third port of the hydraulic pressure switching valve 603*a* and closes the fifth port thereof in a first state. Thus, the hydraulic pressure switching valve 603*a* permits the flow of hydraulic oil between the hydraulic pressure switching valve 603*a* and the first solenoid valve 604 in the first state. Furthermore, the hydraulic pressure switching valve 603*a* blocks the flow of hydraulic oil between the hydraulic pressure switching valve 603*a* and the oil path element L7 in the first state.

On the other hand, the hydraulic pressure switching valve 603*a* closes the second port and the third port of the hydraulic pressure switching valve 603*a* and opens the fifth port thereof in a second state. Thus, the hydraulic pressure switching valve 603*a* blocks the flow of hydraulic oil between the hydraulic pressure switching valve 603*a* and the first solenoid valve 604 in the second state. Furthermore, the hydraulic pressure switching valve 603*a* permits the flow of hydraulic oil between the oil path element L3 and the oil path element L7 in the second state.

In the case of the present embodiment, the hydraulic pressure switching valve 603*a* is in the first state when the pilot solenoid valve 603*b* is in the energized state, and is in the second state when the pilot solenoid valve 603*b* is in the non-energized state.

[First Solenoid Valve]

The first solenoid valve 604 switches between the first state that allows the flow of hydraulic oil from the upstream side to the downstream side and the second state that allows the flow of hydraulic oil from the downstream side to the upstream side in response to energization. In the case of the present embodiment, the first solenoid valve 604 is in the first state when it is in the energized state, and is in the second state when it is in the non-energized state.

The first solenoid valve 604 blocks the flow of hydraulic oil from the downstream side to the upstream side in the first state. On the other hand, the first solenoid valve 604 blocks the flow of hydraulic oil from the upstream side to the downstream side in the second state.

Specifically, the downstream end of the oil path element L4 is connected to a first port of the first solenoid valve 604. The first solenoid valve 604 is connected to the hydraulic pressure switching valve 603*a* via the oil path element L4.

An upstream end of the oil path element L12 is connected to a second port of the first solenoid valve 604. A downstream end of the oil path element L12 is connected to the second solenoid valve 605. The first solenoid valve 604 is connected to the second solenoid valve 605 via the oil path element L12. The configuration of the oil path element L12 is not limited to the one illustrated in the figure.

The downstream end of the oil path element L5 is connected to a third port of the first solenoid valve 604. The first solenoid valve 604 is connected to the hydraulic pressure switching valve 603*a* via the oil path element L5.

This first solenoid valve 604 permits the flow of hydraulic oil between the oil path element L4 and the oil path element L12 in the first state (energized state). On the other hand, the first solenoid valve 604 blocks the flow of hydraulic oil between the oil path element L5 and the oil path element L12 in the first state. Specifically, the first solenoid valve 604 can supply hydraulic oil supplied from the oil path element L4 to the oil path element L12 in the first state.

On the other hand, the first solenoid valve 604 permits the flow of hydraulic oil between the oil path element L5 and the oil path element L12 in the second state. The first solenoid valve 604 blocks the flow of hydraulic oil between the oil path element L4 and the oil path element L12 in the second state. Specifically, the first solenoid valve 604 can supply hydraulic oil supplied from the oil path element L12 to the hydraulic pressure switching valve 603*a* via the oil path element L5 in the second state.

[Second Solenoid Valve]

The second solenoid valve 605 switches between the first state in which hydraulic oil supplied from the upstream side is supplied to the hydraulic chamber 52 of the boom connection mechanism 5 and the second state in which the hydraulic oil supplied from the upstream side is supplied to the hydraulic chamber 42 of the cylinder connection mechanism 4 in response to energization. In the case of the present embodiment, the second solenoid valve 605 is in the first state when it is in the energized state, and is in the second state when it is in the non-energized state.

The second solenoid valve 605 prevents the hydraulic oil supplied from the upstream side from flowing into the hydraulic chamber 42 of the cylinder connection mechanism 4 in the first state. On the other hand, the second solenoid valve 605 prevents the hydraulic oil supplied from the upstream side from flowing into the hydraulic chamber 52 of the boom connection mechanism 5 in the second state.

Specifically, the downstream end of the oil path element L12 is connected to a first port of the second solenoid valve 605.

An upstream end of an oil path element L13 is connected to a second port of the second solenoid valve 605. A downstream end of the oil path element L13 is connected to the hydraulic chamber 42 of the cylinder connection mechanism 4. The second solenoid valve 605 is connected to the hydraulic chamber 42 of the cylinder connection mechanism 4 via the oil path element L13. The configuration of the oil path element L13 is not limited to the one illustrated in the figure.

An upstream end of an oil path element L14 is connected to a third port of the second solenoid valve 605. A downstream end of the oil path element L14 is connected to the hydraulic chamber 52 of the boom connection mechanism 5. The second solenoid valve 605 is connected to the hydraulic chamber 52 of the boom connection mechanism 5 via the oil path element L14.

This second solenoid valve 605 allows the flow of hydraulic oil between the oil path element L12 and the oil path element L14 in the first state (that is, the energized state). That is, the second solenoid valve 605 can supply the hydraulic oil supplied from the oil path element L12 to the hydraulic chamber 52 of the boom connection mechanism 5 via the oil path element L14 in the first state.

On the other hand, the second solenoid valve 605 allows the flow of hydraulic oil between the oil path element L12 and the oil path element L13 in the second state (that is, the non-energized state). That is, the second solenoid valve 605 can supply the hydraulic oil supplied from the oil path element L12 to the hydraulic chamber 42 of the cylinder connection mechanism 4 via the oil path element L13 in the second state.

[Operation of Hydraulic Mechanism]

Figure 3B:
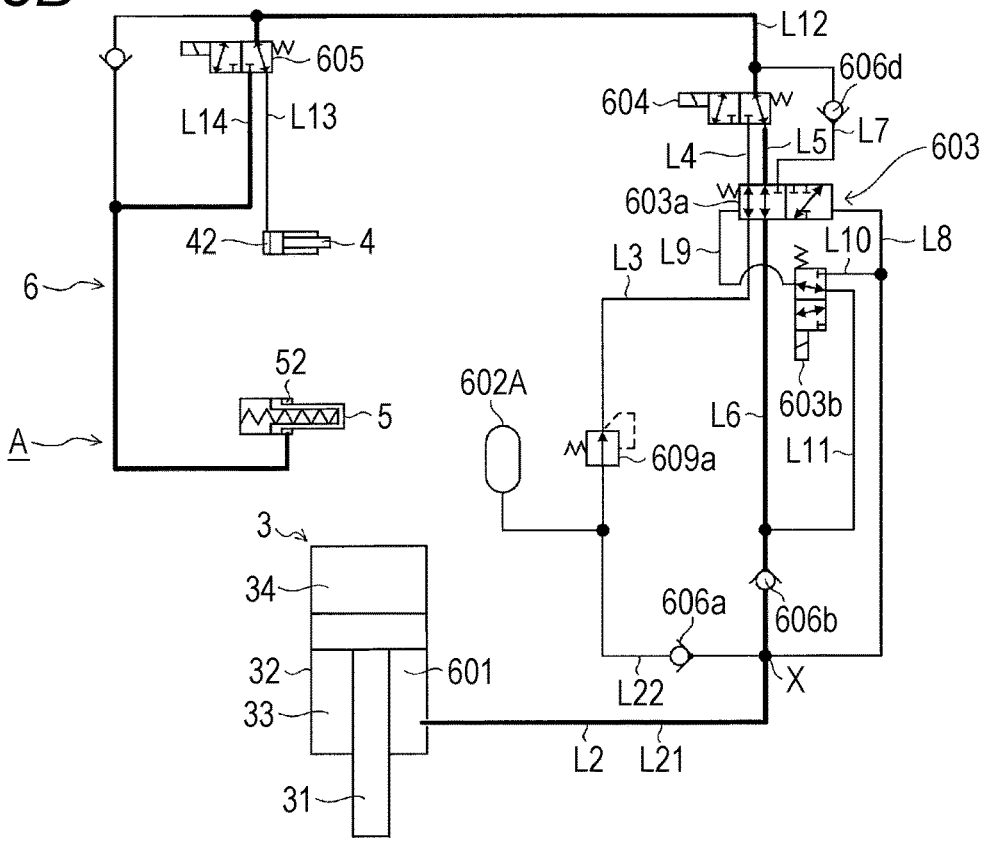
FIG. 3B is a diagram illustrating a state of the hydraulic circuit when the boom connection mechanism is transitioned to an engaged state in the crane according to the first embodiment.
Figure 3C:
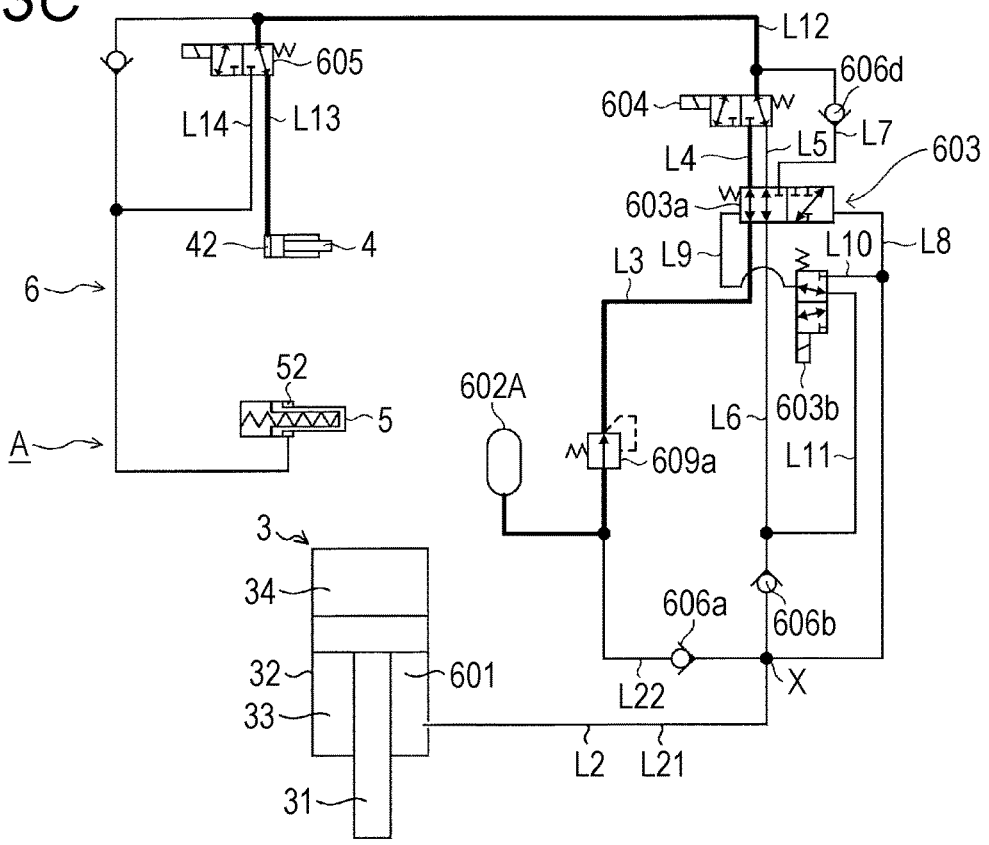
FIG. 3C is a diagram illustrating a state of the hydraulic circuit when a cylinder connection mechanism is transitioned to a disengaged state in the crane according to the first embodiment.
Figure 3D:
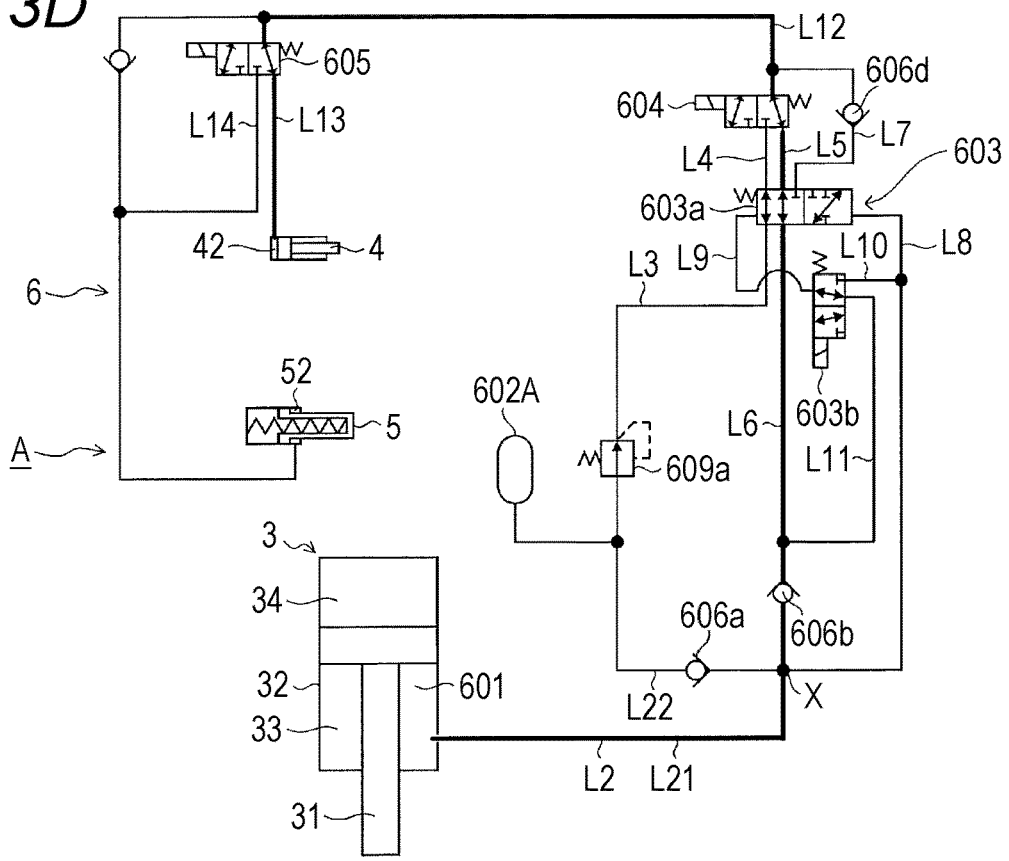
FIG. 3D is a diagram illustrating a state of the hydraulic circuit when the cylinder connection mechanism is transitioned to an engaged state in the crane according to the first embodiment.
Figure 3E:
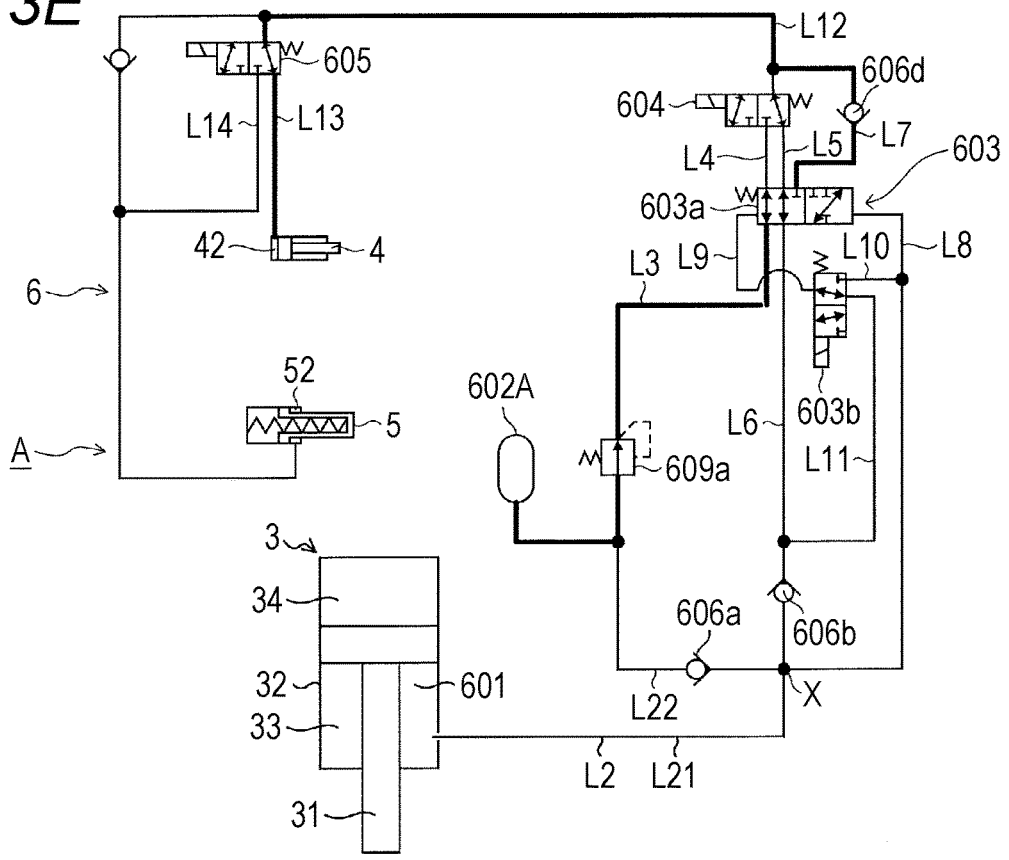
FIG. 3E is a diagram illustrating a state of the hydraulic circuit when the cylinder connection mechanism is transitioned to the disengaged state in an emergency in the crane according to the first embodiment.

Next, the operation of the hydraulic mechanism 6 will be described with reference to FIGS. 3A to 3E. FIG. 3A is a diagram for explaining the operation of the hydraulic mechanism 6 in performing the disengaging operation of the boom connection mechanism 5. FIG. 3B is a diagram for explaining the operation of the hydraulic mechanism 6 in performing the engaging operation of the boom connection mechanism 5. FIG. 3C is a diagram for explaining the operation of the hydraulic mechanism 6 in performing the disengaging operation of the cylinder connection mechanism 4. FIG. 3D is a diagram for explaining the operation of the hydraulic mechanism 6 in performing the engaging operation of the cylinder connection mechanism 4. FIG. 3E is a diagram for explaining the operation of the hydraulic mechanism 6 in performing the disengaging operation of the cylinder connection mechanism 4 in an emergency.

In the following description, it is assumed that the accumulator 602A has accumulated sufficient hydraulic oil to perform each of these operations.

Operation Example 1-1: Disengaging Operation of Boom Connection Mechanism

First, the operation of the hydraulic mechanism 6 in performing the disengaging operation of the boom connection mechanism 5 will be described with reference to FIG. 3A. Since the configuration of each member in the hydraulic mechanism 6 is as described above, any overlapping description will be omitted.

For example, if an operator instructs the disengaging operation of the boom connection mechanism 5 in the state in which the distal end boom element 141 and the intermediate boom element 142 are connected (see FIG. 2A), the first solenoid valve 604, the pilot solenoid valve 603*b*, and the second solenoid valve 605 become the energized state.

As a result, the first solenoid valve 604, the hydraulic pressure switching valve 603*a*, and the second solenoid valve 605 each become the first state. Then, hydraulic oil discharged from the accumulator 602A is supplied to the hydraulic chamber 52 of the boom connection mechanism 5 through the oil path illustrated by the thick solid line in FIG. 3A. The oil path illustrated by the thick solid line in FIG. 3A constitutes a feed oil path in the normal oil path. The feed oil path means an oil path through which hydraulic oil flows from a hydraulic pressure source (the accumulator 602A in the case of this operation example) to the cylinder connection mechanism 4 or the boom connection mechanism 5.

Specifically, the hydraulic oil flows through the accumulator 602A, the oil path element L3, the hydraulic pressure switching valve 603*a*, the oil path element L4, the first solenoid valve 604, the oil path element L12, the second solenoid valve 605, the oil path element L14, and the hydraulic chamber 52 of the boom connection mechanism 5 in this order.

As a result, the boom connection mechanism 5 transitions from the extension state to the contraction state, and the boom connection pins 51*a* are disengaged from the first boom pin receiving portions 142*b* or the second boom pin receiving portions 142*c* of the intermediate boom element 142. In this case, as an example, the boom connection pins 51*a* transition from the state illustrated in FIG. 2A to the state illustrated in FIG. 2B.

Operation Example 1-2: Engaging Operation of Boom Connection Mechanism

Next, the operation of the hydraulic mechanism 6 in performing the engaging operation of the boom connection mechanism 5 will be described with reference to FIG. 3B.

For example, if the operator instructs the engaging operation of the boom connection mechanism 5 in the state in which the distal end boom element 141 and the intermediate boom element 142 are not connected (see FIG. 2B), the second solenoid valve 605 and the pilot solenoid valve 603*b* become the energized state, whereas the first solenoid valve 604 becomes the non-energized state.

As a result, the second solenoid valve 605 and the hydraulic pressure switching valve 603*a* become the first state, whereas the first solenoid valve 604 becomes the second state. Then, hydraulic oil in the hydraulic chamber 52 of the boom connection mechanism 5 returns to the cylinder side hydraulic pressure source 601 through the oil path illustrated by the thick solid line in FIG. 3B. The oil path illustrated by the thick solid line in FIG. 3B constitutes a return oil path in the normal oil path. The return oil path means an oil path through which hydraulic oil flows from the cylinder connection mechanism 4 or the boom connection mechanism 5 to a hydraulic pressure source (the cylinder side hydraulic pressure source 601 in the case of this operation example).

Specifically, the hydraulic oil flows through the hydraulic chamber 52 of the boom connection mechanism 5, the oil path element L14, the second solenoid valve 605, the oil path element L12, the first solenoid valve 604, the oil path element L5, the hydraulic pressure switching valve 603*a*, the oil path element L6, the upstream oil path element L21, and the cylinder side hydraulic pressure source 601 in this order.

As a result, the boom connection mechanism 5 transitions from the extension state to the contraction state, and the boom connection pins 51*a* are inserted across the boom pin receiving portions 141*b* of the distal end boom element 141 and the first boom pin receiving portions 142*b* (or the second boom pin receiving portions 142*c*) of the intermediate boom element 142. In this case, as an example, the boom connection pins 51*a* transition from the state illustrated in FIG. 2B to the state illustrated in FIG. 2A.

Operation Example 1-3: Disengaging Operation of Cylinder Connection Mechanism Next, the operation of the hydraulic mechanism 6 in performing the disengaging operation of the cylinder connection mechanism 4 will be described with reference to FIG. 3C.

For example, if the operator instructs the disengaging operation of the cylinder connection mechanism 4 in the state of connection between the distal end boom element 141 and the cylinder member 32 as illustrated in FIG. 2D, the first solenoid valve 604 and the pilot solenoid valve 603*b* become the energized state, whereas the second solenoid valve 605 becomes the non-energized state.

As a result, the first solenoid valve 604 and the hydraulic pressure switching valve 603*a* become the first state, whereas the second solenoid valve 605 becomes the second state. Then, the hydraulic oil discharged from the accumulator 602A is supplied to the hydraulic chamber 42 of the cylinder connection mechanism 4 through the oil path (also referred to as a first oil path) illustrated by the thick solid line in FIG. 3C. The oil path illustrated by the thick solid line in FIG. 3C constitutes a feed oil path in the normal oil path.

Specifically, the hydraulic oil flows through the accumulator 602A, the oil path element L3, the hydraulic pressure switching valve 603*a*, the oil path element L4, the first solenoid valve 604, the oil path element L12, the second solenoid valve 605, the oil path element L13, and the hydraulic chamber 42 of the cylinder connection mechanism 4 in this order.

As a result, the cylinder connection mechanism 4 transitions from the extension state to the contraction state, and the pair of cylinder connection pins 41 are disengaged from the cylinder pin receiving portions 141*a* of the distal end boom element 141. That is, the pair of cylinder connection pins 41 transition from the state illustrated in FIG. 2D to the state illustrated in FIG. 2E.

Operation Example 1-4: Engaging Operation of Cylinder Connection Mechanism

Next, the operation of the hydraulic mechanism 6 in performing the engaging operation of the cylinder connection mechanism 4 will be described with reference to FIG. 3D.

For example, if the operator instructs the engaging operation of the cylinder connection mechanism 4 in the state of non-connection between the distal end boom element 141 and the cylinder member 32 as illustrated in FIG. 2E, the pilot solenoid valve 603*b* becomes the energized state, whereas the first solenoid valve 604 and the second solenoid valve 605 become the non-energized state.

As a result, the hydraulic pressure switching valve 603*a* becomes the first state, whereas the first solenoid valve 604 and the second solenoid valve 605 become the second state. Then, hydraulic oil in the hydraulic chamber 42 of the cylinder connection mechanism 4 returns to the cylinder side hydraulic pressure source 601 through the oil path illustrated by the thick solid line in FIG. 3D. The oil path illustrated by the thick solid line in FIG. 3D constitutes a return oil path in the normal oil path.

Specifically, the hydraulic oil flows through the hydraulic chamber 42 of the cylinder connection mechanism 4, the oil path element L13, the second solenoid valve 605, the oil path element L12, the first solenoid valve 604, the oil path element L5, the hydraulic pressure switching valve 603*a*, the oil path element L6, the upstream oil path element L21, and the cylinder side hydraulic pressure source 601 in this order.

As a result, the cylinder connection mechanism 4 transitions from the contraction state to the extension state, and the pair of cylinder connection pins 41 are inserted into the cylinder pin receiving portions 141*a* of the distal end boom element 141. In this case, as an example, the pair of cylinder connection pins 41 transition from the state illustrated in FIG. 2E to the state illustrated in FIG. 2D.

Operation Example 1-5: Operation in Emergency

Next, the operation of the hydraulic mechanism 6 in performing the disengaging operation of the cylinder connection mechanism 4 in an emergency will be described with reference to FIG. 3E. In the present embodiment, the term "emergency" means a situation in which the first solenoid valve 604, the pilot solenoid valve 603*b*, and the second solenoid valve 605 cannot be energized and the switching of these valves cannot be performed. Causes of such an emergency include failure of the first solenoid valve 604, the pilot solenoid valve 603*b*, or the second solenoid valve 605, disconnection of the wiring (cord reel) that supplies power to each of these valves, and the like.

For example, the operator instructs the disengaging operation of the cylinder connection mechanism 4 in an emergency through a predetermined operation (a switch operation, for example) if the first solenoid valve 604, the pilot solenoid valve 603*b*, and the second solenoid valve 605 cannot be energized in the state of connection between the distal end boom element 141 and the cylinder member 32 as illustrated in FIG. 2D.

With the telescopic cylinder 3 (see FIG. 3A) transitioning in the contraction direction in response to the above-described instruction, hydraulic oil is supplied from the cylinder side hydraulic pressure source 601 via the upstream oil path element L21 and the oil path element L8 to the sixth port of the hydraulic pressure switching valve 603*a*. Then, the hydraulic pressure switching valve 603*a* transitions from the first state to the second state. In this state, the hydraulic pressure switching valve 603*a* permits the flow of hydraulic oil between the oil path element L3 and the oil path element L7 (bypass oil path).

As a result, the hydraulic oil discharged from the accumulator 602A is supplied to the hydraulic chamber 42 of the cylinder connection mechanism 4 through the oil path (also referred to as a second oil path) illustrated by the thick solid line in FIG. 3E. The oil path illustrated by the thick solid line in FIG. 3E constitutes a feed oil path in the emergency oil path.

Specifically, the hydraulic oil flows through the accumulator 602A, the oil path element L3, the hydraulic pressure switching valve 603*a*, the oil path element L7 (bypass oil path), the oil path element L12, the second solenoid valve 605, the oil path element L13, and the hydraulic chamber 42 of the cylinder connection mechanism 4 in this order.

As a result, the cylinder connection mechanism 4 transitions from the extension state to the contraction state, and the pair of cylinder connection pins 41 are disengaged from the cylinder pin receiving portions 141*a* of the distal end boom element 141. In this case, as an example, the pair of cylinder connection pins 41 transition from the state illustrated in FIG. 2D to the state illustrated in FIG. 2E.

Actions/Effects of Present Embodiment

As described above, according to the present embodiment, the cylinder pins (specifically, the pair of cylinder connection pins 41) can be disengaged from boom elements (for example, the cylinder pin receiving portions 141*a* of the distal end boom element 141) (see FIG. 2E) in an emergency in which the first solenoid valve 604, the pilot solenoid valve 603*b*, and the second solenoid valve 605 cannot be energized and the switching of these valves cannot be performed. As a result, the telescopic cylinder 3 can contract in an emergency.

Second Embodiment

A second embodiment according to the present invention will be described with reference to FIGS. 4A to 4E. In the case of the present embodiment, the configuration of a hydraulic mechanism 6B is different from that in the above-described first embodiment. The configurations of the other parts are the same as those in the first embodiment. Hereinafter, the hydraulic mechanism 6B will be described.

[Hydraulic Mechanism]

The hydraulic mechanism 6B includes the cylinder side hydraulic pressure source 601, the accumulator 602A, a first solenoid valve 604B, the second solenoid valve 605, and an emergency switching mechanism 611.

The cylinder side hydraulic pressure source 601, the accumulator 602A, and the second solenoid valve 605 are the same as those in the first embodiment described above.

In the case of the present embodiment, a counterbalance valve 601*a* is provided in an oil path element L1*a* connecting the extension side hydraulic chamber 34 and a hydraulic pump (not illustrated) that is driven based on the driving force of an engine (not illustrated). The counterbalance valve 601*a* prevents the cylinder member 32 of the telescopic cylinder 3 from being pushed back by load applied from the telescopic boom 14 (see FIGS. 1, 2A to 2E).

To this counterbalance valve 601*a*, the hydraulic pressure of an oil path element L1*b* connecting the contraction side hydraulic chamber 33 and the hydraulic pump is applied as a pilot pressure via an oil path element L1*c*. The counterbalance valve 601*a* always allows the flow of hydraulic oil from the hydraulic pump to the extension side hydraulic chamber 34.

Furthermore, the counterbalance valve 601*a* basically prevents hydraulic oil discharged from the extension side hydraulic chamber 34 from passing therethrough. The counterbalance valve 601*a* however allows the hydraulic oil discharged from the extension side hydraulic chamber 34 to pass therethrough only when the hydraulic oil is supplied to the contraction side hydraulic chamber 33.

The oil path element L1*c* is provided with a cock 612. This cock 612 can be manually or automatically switched between open and closed states. The cock 612 allows the flow of hydraulic oil from the upstream side (the oil path element L1*b* side) to the downstream side (the oil path element L1*a* side) in the open state. Furthermore, the cock 612 blocks the flow of hydraulic oil from the upstream side (the oil path element L1*b* side) to the downstream side (the oil path element L1*a* side) in the closed state. In the case of the present embodiment, the cock 612 is in the open state in normal times.

[First Solenoid Valve]

The first solenoid valve 604B switches between the first state that allows the flow of hydraulic oil from the upstream side to the downstream side and the second state that allows the flow of hydraulic oil from the downstream side to the upstream side in response to energization. In the case of the present embodiment, the first solenoid valve 604B is in the first state when it is in the energized state, and is in the second state when it is in the non-energized state.

The first solenoid valve 604B blocks the flow of hydraulic oil from the downstream side to the upstream side in the first state. On the other hand, the first solenoid valve 604B blocks the flow of hydraulic oil from the upstream side to the downstream side in the second state.

Specifically, the downstream end of the oil path element L3 is connected to a first port of the first solenoid valve 604B. An upstream end of the oil path element L3 is connected to an output port of the accumulator 602A. Furthermore, the oil path element L3 is provided with the pressure reducing valve 609*a*. The first solenoid valve 604B is connected to the accumulator 602A via the oil path element L3.

The upstream end of the oil path element L12 is connected to a second port of the first solenoid valve 604B. A downstream end of the oil path element L12 is connected to the second solenoid valve 605. The first solenoid valve 604B is connected to the second solenoid valve 605 via the oil path element L12.

The downstream end of the oil path element L6 is connected to a third port of the first solenoid valve 604B. The upstream end of the oil path element L6 is connected to the branch point X. The first solenoid valve 604B is connected to the cylinder side hydraulic pressure source 601 via the oil path element L6 and the upstream oil path element L21.

This first solenoid valve 6048 can supply hydraulic oil supplied from the oil path element L3 to the second solenoid valve 605 via the oil path element L12 in the first state.

On the other hand, the first solenoid valve 604B can supply the hydraulic oil supplied from the oil path element L12 to the cylinder side hydraulic pressure source 601 via the oil path element L6 and the upstream oil path element L21 in the second state.

[Emergency Switching Mechanism]

The emergency switching mechanism 611 is provided to an oil path element L17. An upstream end of the oil path element L17 is connected to the upstream oil path element L21. That is, the oil path element L17 is connected to the cylinder side hydraulic pressure source 601 via the upstream oil path element L21. A downstream end of the oil path element L17 is connected to the oil path element L12.

The emergency switching mechanism 611 includes a relief valve 610*c* and a pressure reducing valve 609*b* in this order from the upstream side in the oil path element L17. In the oil path element L17, the oil path on the upstream side of the relief valve 610*c* is an oil path element L171. In the oil path element L17, the oil path between the relief valve 610*c* and the pressure reducing valve 609*b* is an oil path element L172. Furthermore, in the oil path element L17, the oil path on the downstream side of the relief valve 610*c* is an oil path element L173.

The relief valve 610*c* is normally in a closed state. This relief valve 610*c* becomes an open state when the hydraulic pressure in the oil path on the upstream side becomes equal to or higher than a predetermined pressure (valve opening pressure). In the open state, the relief valve 610*c* allows the flow of hydraulic oil from the upstream side to the downstream side.

The pressure reducing valve 609*b* reduces the pressure of the hydraulic oil flowing in from the upstream side and supplies it to the downstream side. The other configuration of the hydraulic mechanism 6B is almost the same as that in the first embodiment described above.

[Operation of Hydraulic Mechanism]

Figure 4A:
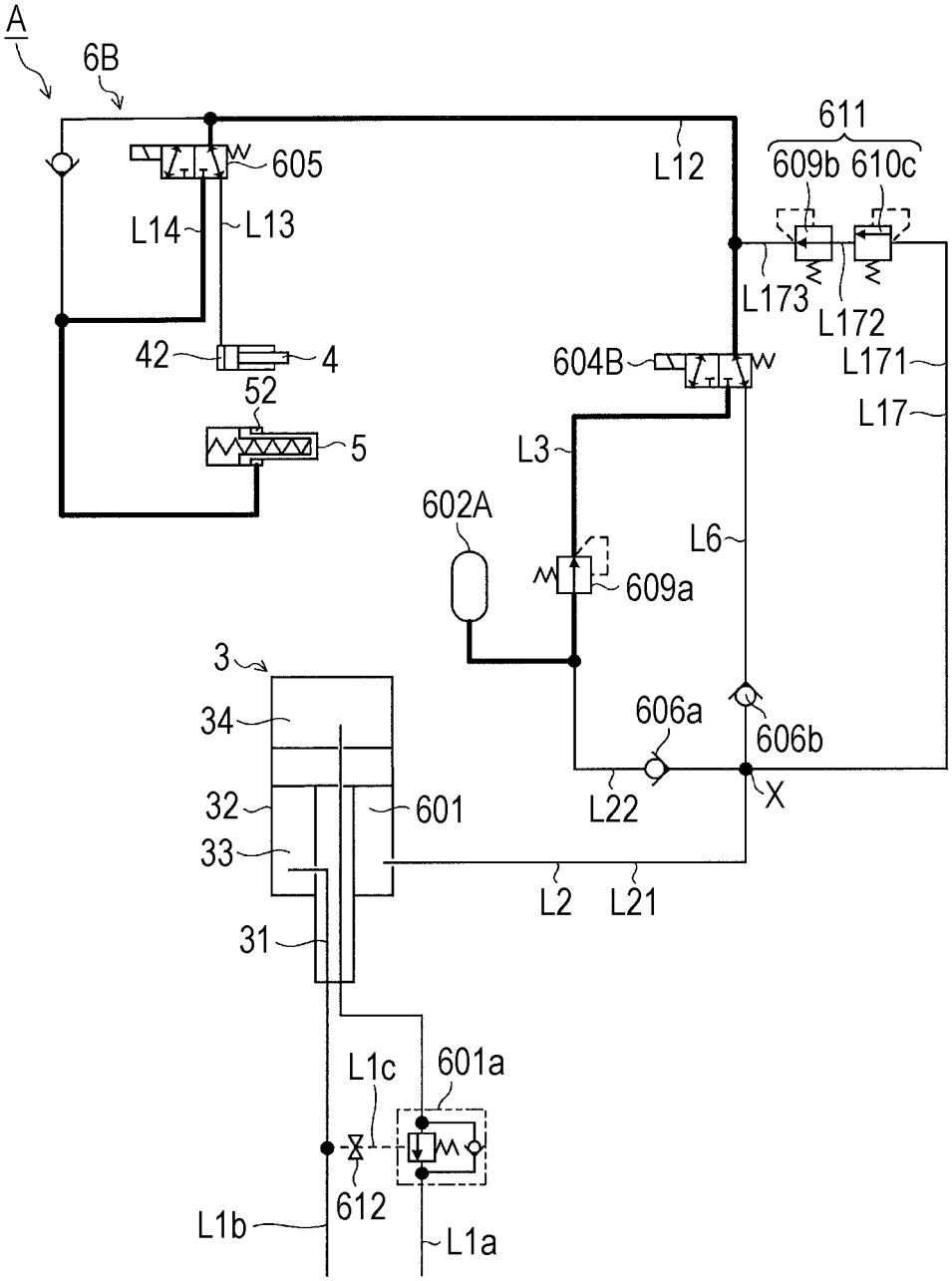
FIG. 4A is a diagram illustrating a state of a hydraulic circuit when a boom connection mechanism is transitioned to a disengaged state in a crane according to a second embodiment.
Figure 4B:
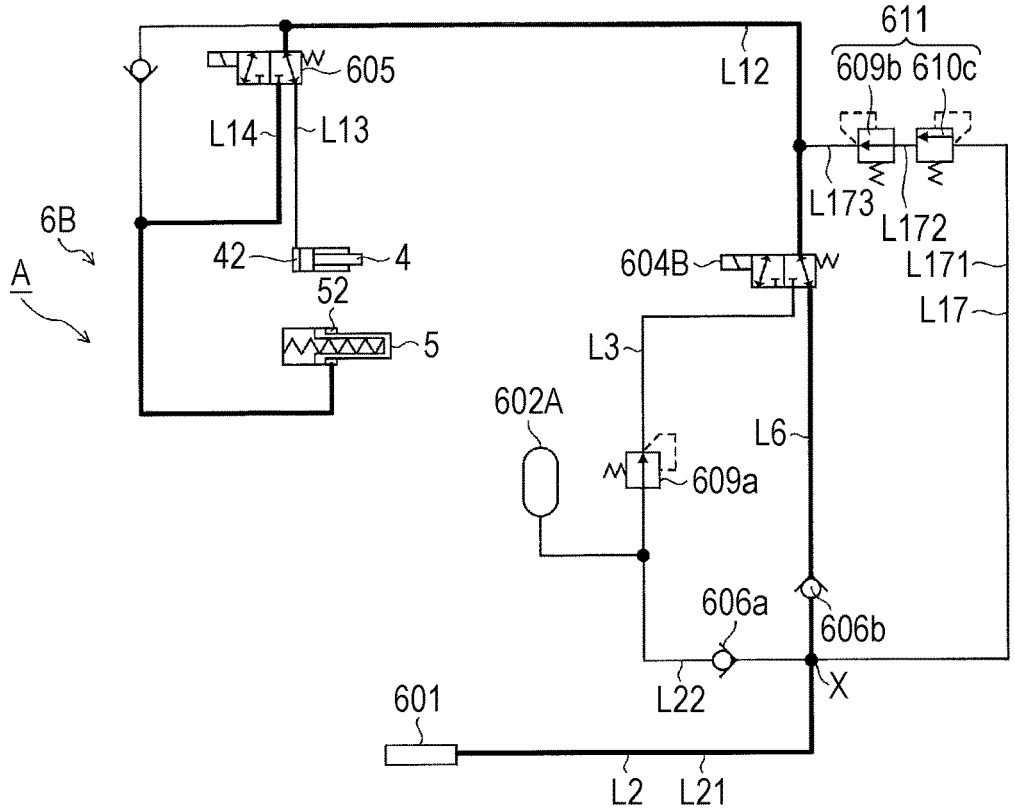
FIG. 4B is a diagram illustrating a state of the hydraulic circuit when the boom connection mechanism is transitioned to an engaged state in the crane according to the second embodiment.
Figure 4C:
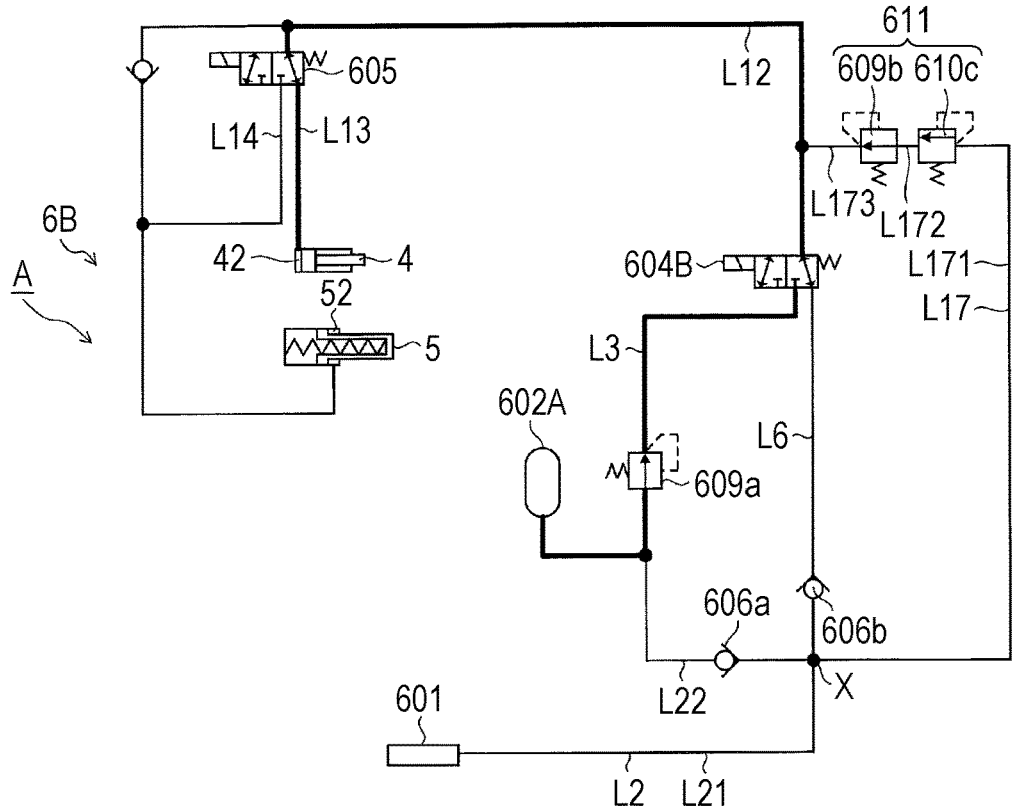
FIG. 4C is a diagram illustrating a state of the hydraulic circuit when a cylinder connection mechanism is transitioned to a disengaged state in the crane according to the second embodiment.
Figure 4D:
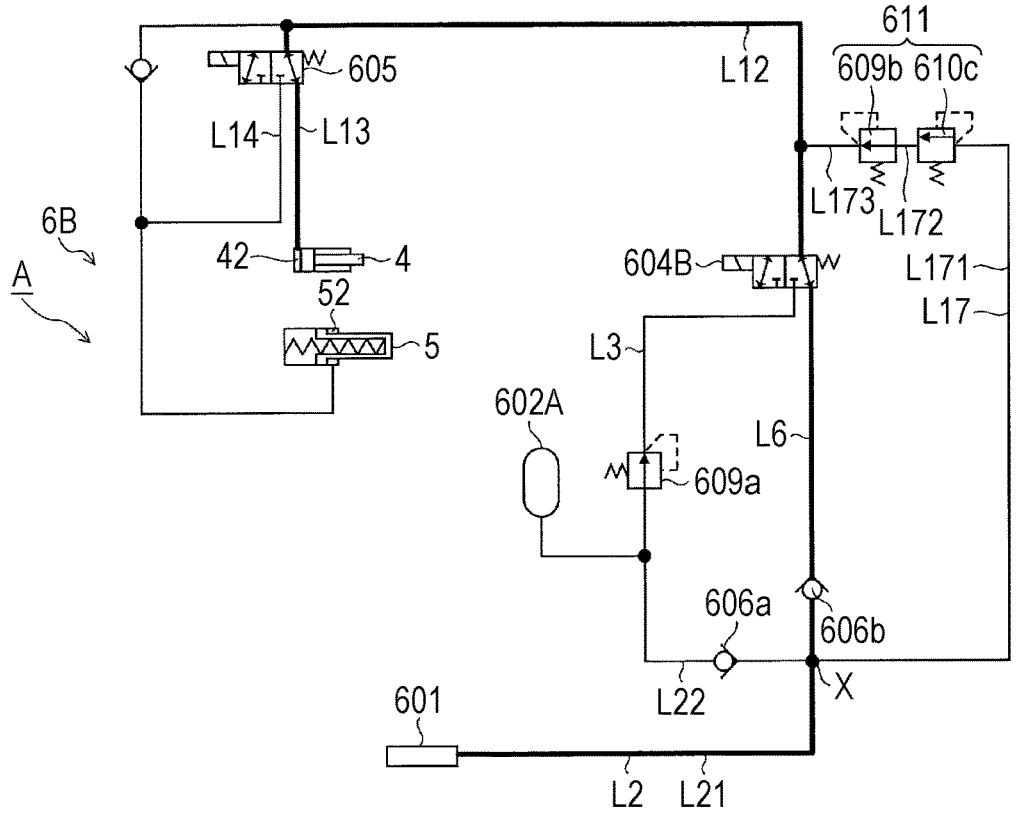
FIG. 4D is a diagram illustrating a state of the hydraulic circuit when the cylinder connection mechanism is transitioned to an engaged state in the crane according to the second embodiment.
Figure 4E:
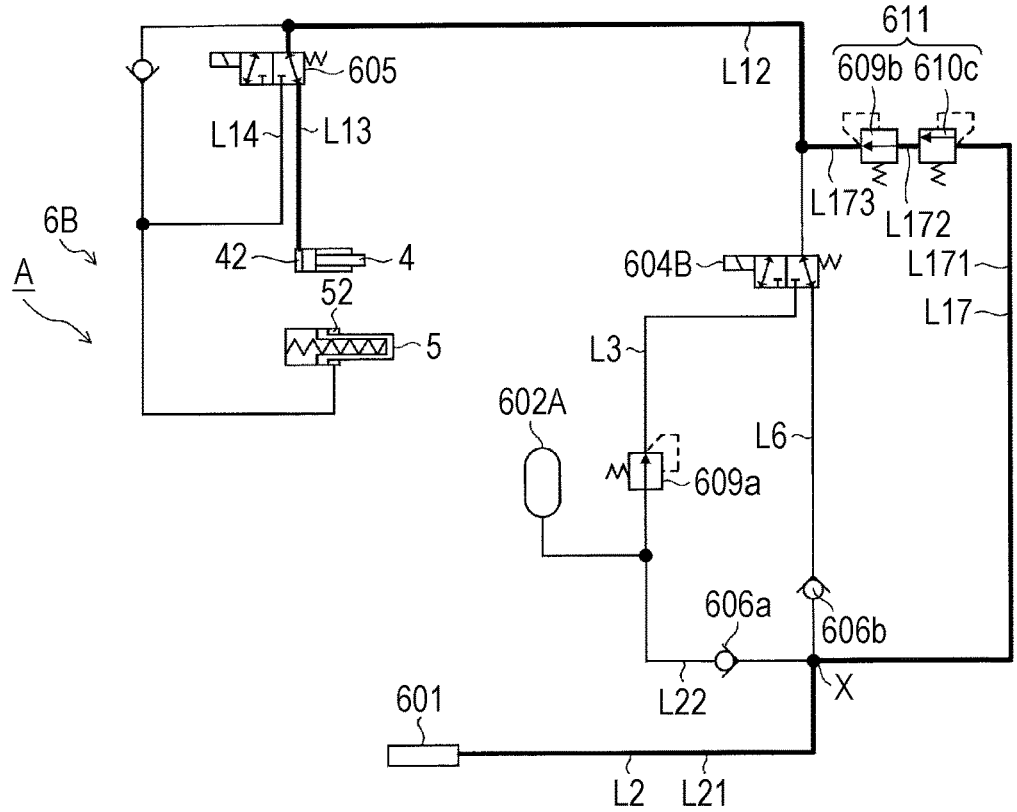
FIG. 4E is a diagram illustrating a state of the hydraulic circuit when the cylinder connection mechanism is transitioned to the disengaged state in an emergency in the crane according to the second embodiment.

Next, the operation of the hydraulic mechanism 6B will be described with reference to FIGS. 4A to 4E. FIG. 4A is a diagram for explaining the operation of the hydraulic mechanism 6B in performing the disengaging operation of the boom connection mechanism 5. FIG. 4B is a diagram for explaining the operation of the hydraulic mechanism 6B in performing the engaging operation of the boom connection mechanism 5. FIG. 4C is a diagram for explaining the operation of the hydraulic mechanism 6B in performing the disengaging operation of the cylinder connection mechanism 4. FIG. 4D is a diagram for explaining the operation of the hydraulic mechanism 6B in performing the engaging operation of the cylinder connection mechanism 4. FIG. 4E is a diagram for explaining the operation of the hydraulic mechanism 6B in performing the disengaging operation of the cylinder connection mechanism 4 in an emergency.

In the following description, it is assumed that the accumulator 602A has accumulated sufficient hydraulic oil to perform each of these operations.

Operation Example 2-1: Disengaging Operation of Boom Connection Mechanism

First, the operation of the hydraulic mechanism 6B in performing the disengaging operation of the boom connection mechanism 5 will be described with reference to FIG. 4A. Since the configuration of each member in the hydraulic mechanism 6B is as described above, any overlapping description will be omitted.

For example, if the operator instructs the disengaging operation of the boom connection mechanism 5 in the state in which the distal end boom element 141 and the intermediate boom element 142 are connected (see FIG. 2A), the first solenoid valve 604B and the second solenoid valve 605 become the energized state.

As a result, the first solenoid valve 604B and the second solenoid valve 605 become the first state. Then, the hydraulic oil discharged from the accumulator 602A is supplied to the hydraulic chamber 52 of the boom connection mechanism 5 through the oil path illustrated by the thick solid line in FIG. 4A. The oil path illustrated by the thick solid line in FIG. 4A constitutes a feed oil path in the normal oil path.

Specifically, the hydraulic oil flows through the accumulator 602A, the oil path element L3, the first solenoid valve 604B, the oil path element L12, the second solenoid valve 605, the oil path element L14, and the hydraulic chamber 52 of the boom connection mechanism 5 in this order.

As a result, the boom connection mechanism 5 transitions from the extension state to the contraction state, and the boom connection pins 51*a* are disengaged from the first boom pin receiving portions 142*b* or the second boom pin receiving portions 142*c* of the intermediate boom element 142. In this case, as an example, the boom connection pins 51*a* transition from the state illustrated in FIG. 2A to the state illustrated in FIGS. 2B and 2C.

Operation Example 2-2: Engaging Operation of Boom Connection Mechanism

Next, the operation of the hydraulic mechanism 6B in performing the engaging operation of the boom connection mechanism 5 will be described with reference to FIG. 4B.

For example, if the operator instructs the engaging operation of the boom connection mechanism 5 in the state in which the distal end boom element 141 and the intermediate boom element 142 are not connected (see FIGS. 2B and 2C), the second solenoid valve 605 becomes the energized state, whereas the first solenoid valve 604B becomes the non-energized state.

As a result, the second solenoid valve 605 becomes the first state, whereas the first solenoid valve 604B becomes the second state. Then, the hydraulic oil in the hydraulic chamber 52 of the boom connection mechanism 5 returns to the cylinder side hydraulic pressure source 601 through the oil path illustrated by the thick solid line in FIG. 4B. The oil path illustrated by the thick solid line in FIG. 4B constitutes a return oil path in the normal oil path.

Specifically, the hydraulic oil flows through the hydraulic chamber 52 of the boom connection mechanism 5, the oil path element L14, the second solenoid valve 605, the oil path element L12, the first solenoid valve 604B, the oil path element L6, the upstream oil path element L21, and the cylinder side hydraulic pressure source 601 in this order.

As a result, the boom connection mechanism 5 transitions from the contraction state to the extension state, and the boom connection pins 51*a* are inserted across the boom pin receiving portions 141*b* of the distal end boom element 141 and the first boom pin receiving portions 142*b* (or the second boom pin receiving portions 142*c*) of the intermediate boom element 142. In this case, as an example, the boom connection pins 51*a* transition from the state illustrated in FIG. 2B to the state illustrated in FIG. 2A.

Operation Example 2-3: Disengaging Operation of Cylinder Connection Mechanism

Next, the operation of the hydraulic mechanism 6B in performing the disengaging operation of the cylinder connection mechanism 4 will be described with reference to FIG. 4C.

For example, if the operator instructs the disengaging operation of the cylinder connection mechanism 4 in the state of connection between the distal end boom element 141 and the cylinder member 32 as illustrated in FIG. 2D, the first solenoid valve 604B becomes the energized state, whereas the second solenoid valve 605 becomes the non-energized state.

As a result, the first solenoid valve 604B becomes the first state, whereas the second solenoid valve 605 becomes the second state. Then, the hydraulic oil discharged from the accumulator 602A is supplied to the hydraulic chamber 42 of the cylinder connection mechanism 4 through the oil path (also referred to as the first oil path) illustrated by the thick solid line in FIG. 4C. The oil path illustrated by the thick solid line in FIG. 4C constitutes a feed oil path in the normal oil path.

Specifically, the hydraulic oil flows through the accumulator 602A, the oil path element L3, the first solenoid valve 604B, the oil path element L12, the second solenoid valve 605, the oil path element L13, and the hydraulic chamber 42 of the cylinder connection mechanism 4 in this order.

As a result, the cylinder connection mechanism 4 transitions from the extension state to the contraction state, and the pair of cylinder connection pins 41 are disengaged from the cylinder pin receiving portions 141*a* of the distal end boom element 141. In this case, as an example, the pair of cylinder connection pins 41 transition from the state illustrated in FIG. 2D to the state illustrated in FIG. 2E.

Operation Example 2-4: Engaging Operation of Cylinder Connection Mechanism

Next, the operation of the hydraulic mechanism 6B in performing the engaging operation of the cylinder connection mechanism 4 will be described with reference to FIG. 4D.

For example, if the operator instructs the engaging operation of the cylinder connection mechanism 4 in the state of non-connection between the distal end boom element 141 and the cylinder member 32 as illustrated in FIG. 2E, the first solenoid valve 604B and the second solenoid valve 605 become the non-energized state.

As a result, the first solenoid valve 604B and the second solenoid valve 605 become the second state. Then, the hydraulic oil in the hydraulic chamber 42 of the cylinder connection mechanism 4 returns to the cylinder side hydraulic pressure source 601 through the oil path illustrated by the thick solid line in FIG. 4D. The oil path illustrated by the thick solid line in FIG. 4D constitutes a return oil path in the normal oil path.

Specifically, the hydraulic oil flows through the hydraulic chamber 42 of the cylinder connection mechanism 4, the oil path element L13, the second solenoid valve 605, the oil path element L12, the first solenoid valve 604B, the oil path element L6, the upstream oil path element L21, and the cylinder side hydraulic pressure source 601 in this order.

As a result, the cylinder connection mechanism 4 transitions from the contraction state to the extension state, and the pair of cylinder connection pins 41 are inserted into the cylinder pin receiving portions 141*a* of the distal end boom element 141. In this case, as an example, the pair of cylinder connection pins 41 transition from the state illustrated in FIG. 2E to the state illustrated in FIG. 2D.

Operation Example 2-5: Operation in Emergency

Next, the operation of the hydraulic mechanism 6B in performing the disengaging operation of the cylinder connection mechanism 4 in an emergency will be described with reference to FIG. 4E. In the present embodiment, the term "emergency" means a situation in which the first solenoid valve 604B and the second solenoid valve 605 cannot be energized and the switching of these valves cannot be performed.

For example, the operator closes the cock 612 (see FIG. 4A) if the first solenoid valve 604B and the second solenoid valve 605 cannot be energized in the state of connection between the distal end boom element 141 and the cylinder member 32 as illustrated in FIG. 2D. Then, the pilot pressure from the oil path element L1*b* acting on the counterbalance valve 601*a* decreases, and the counterbalance valve 601*a* blocks the passage of hydraulic oil discharged from the contraction side hydraulic chamber 33 of the telescopic cylinder 3. Then, the operator instructs the disengaging operation of the cylinder connection mechanism 4 in an emergency through a predetermined operation (a switch operation, for example).

With the telescopic cylinder 3 transitioning in the contraction direction in response to the above-described instruction, the hydraulic pressure in the contraction side hydraulic chamber 33 increases, whereby hydraulic oil is supplied from the cylinder side hydraulic pressure source 601 (also referred to as a hydraulic pressure source) to the emergency switching mechanism 611. Since the hydraulic pressure of such hydraulic oil exceeds the valve opening pressure for the relief valve 610*c*, the hydraulic oil passes through the relief valve 610*c*. The hydraulic oil that has passed through the relief valve 610*c* is depressurized by the pressure reducing valve 609*b* and flows into the oil path element L12.

As a result, the hydraulic oil discharged from the cylinder side hydraulic pressure source 601 is supplied to the hydraulic chamber 42 of the cylinder connection mechanism 4 through the oil path (also referred to as the second oil path) illustrated by the thick solid line in FIG. 4E. The oil path illustrated by the thick solid line in FIG. 4E constitutes a feed oil path in the emergency oil path.

Specifically, the hydraulic oil flows through the cylinder side hydraulic pressure source 601, the upstream oil path element L21, the oil path element L171, the relief valve 610*c*, the oil path element L172, the pressure reducing valve 609*b*, the oil path element L173, the oil path element L12, the second solenoid valve 605, the oil path element L13, and the hydraulic chamber 42 of the cylinder connection mechanism 4 in this order.

As a result, the cylinder connection mechanism 4 transitions from the extension state to the contraction state, and the pair of cylinder connection pins 41 are disengaged from the cylinder pin receiving portions 141*a* of the distal end boom element 141. In this case, as an example, the pair of cylinder connection pins 41 transition from the state illustrated in FIG. 2D to the state illustrated in FIG. 2E. Other configurations and actions/effects are the same as in the above-described first embodiment.

Third Embodiment

A third embodiment according to the present invention will be described with reference to FIGS. 5A to 5E. In the case of the present embodiment, the configuration of a hydraulic mechanism 6C is different from that in the above-described first embodiment. The configurations of the other parts are the same as those in the first embodiment. Hereinafter, the hydraulic mechanism 6C will be described.

The hydraulic mechanism 6C includes the cylinder side hydraulic pressure source 601, the accumulator 602A, the first solenoid valve 604B, the second solenoid valve 605, and an emergency switching valve 613.

The cylinder side hydraulic pressure source 601, the accumulator 602A, and the second solenoid valve 605 are the same as those in the first embodiment described above. The first solenoid valve 604B is the same as that in the second embodiment described above.

The emergency switching valve 613 is a second valve and is provided to the oil path element L12. In the oil path element L12, the oil path on the upstream side of the emergency switching valve 613 is an oil path element L121. Furthermore, in the oil path element L12, the oil path on the downstream side of the emergency switching valve 613 is an oil path element L122.

The emergency switching valve 613 can be manually switched between the first state and the second state by the operator. The means for switching the emergency switching valve 613 is not limited to the manual operation made by the operator. For example, the emergency switching valve 613 may be mechanically switched by a device driven in response to a predetermined operation (a switch operation, for example) made by the operator.

A downstream end of the oil path element L121 is connected to a first port of the emergency switching valve 613. An upstream end of the oil path element L121 is connected to the second port of the first solenoid valve 604B. The emergency switching valve 613 is connected to the first solenoid valve 604B via the oil path element L121.

An upstream end of the oil path element L122 is connected to a second port of the emergency switching valve 613. A downstream end of the oil path element L122 is connected to the second solenoid valve 605. The emergency switching valve 613 is connected to the second solenoid valve 605 via the oil path element L122.

A downstream end of the oil path element L18 is connected to a third port of the emergency switching valve 613. An upstream end of the oil path element L18 is connected to the oil path element L3. The oil path element L18 is a bypass oil path that bypasses the first solenoid valve 604B. The oil path element L18 is connected to the accumulator 602A via the oil path element L3.

The emergency switching valve 613 as described above permits the flow of hydraulic oil between the oil path element L121 and the oil path element L122 in the first state. In other words, the emergency switching valve 613 allows the flow of hydraulic oil between the first solenoid valve 604B and the second solenoid valve 605 in the first state. The emergency switching valve 613 blocks the flow of hydraulic oil between the oil path element L18 and the oil path element L122 in the first state.

On the other hand, the emergency switching valve 613 permits the flow of hydraulic oil between the oil path element L18 and the oil path element L122 in the second state. In other words, the emergency switching valve 613 allows the flow of hydraulic oil between the accumulator 602A and the second solenoid valve 605 in the second state. The emergency switching valve 613 blocks the flow of hydraulic oil between the oil path element L121 and the oil path element L122 in the second state.

[Operation of Hydraulic Mechanism]

Figure 5A:
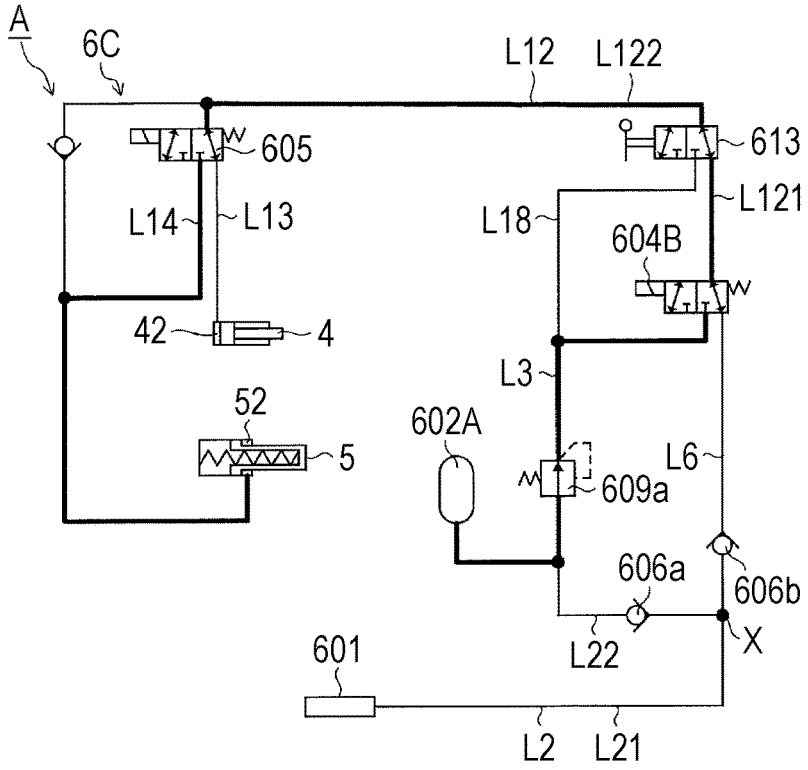
FIG. 5A is a diagram illustrating a state of a hydraulic circuit when a boom connection mechanism is transitioned to a disengaged state in a crane according to a third embodiment.
Figure 5B:
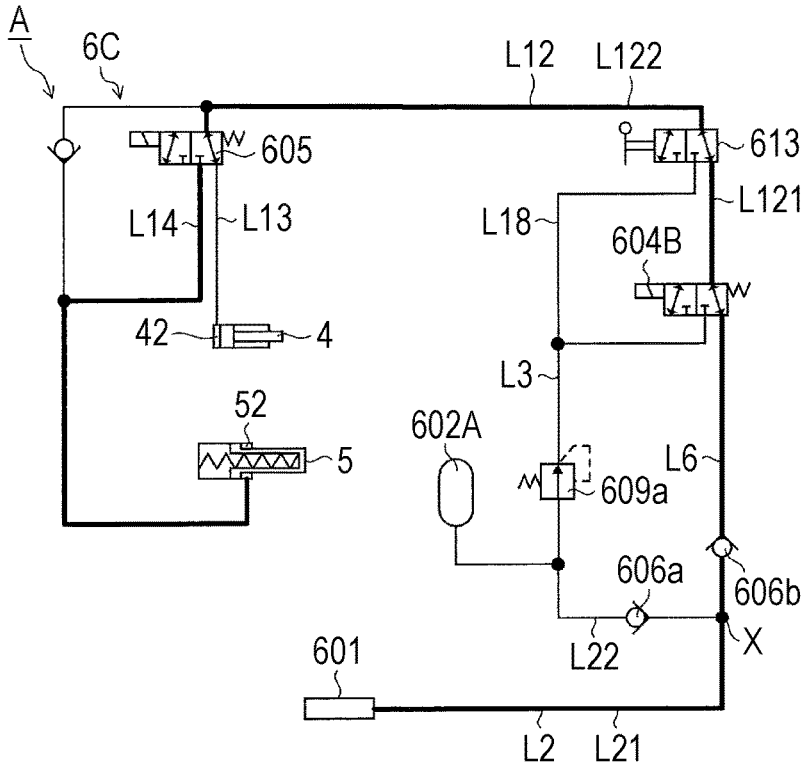
FIG. 5B is a diagram illustrating a state of the hydraulic circuit when the boom connection mechanism is transitioned to an engaged state in the crane according to the third embodiment.
Figure 5C:
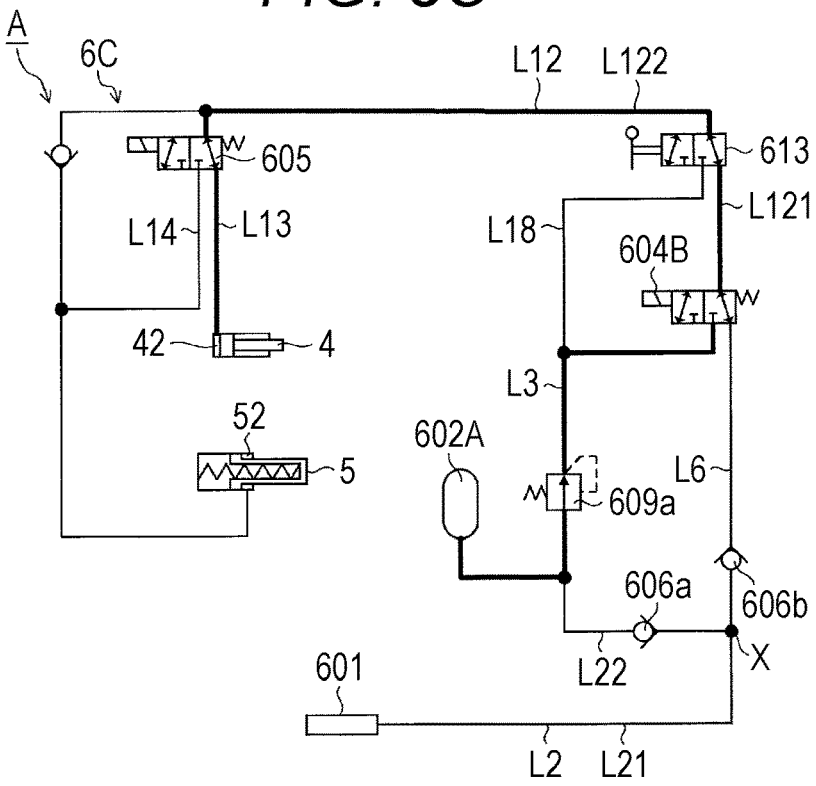
FIG. 5C is a diagram illustrating a state of the hydraulic circuit when a cylinder connection mechanism is transitioned to a disengaged state in the crane according to the third embodiment.
Figure 5D:
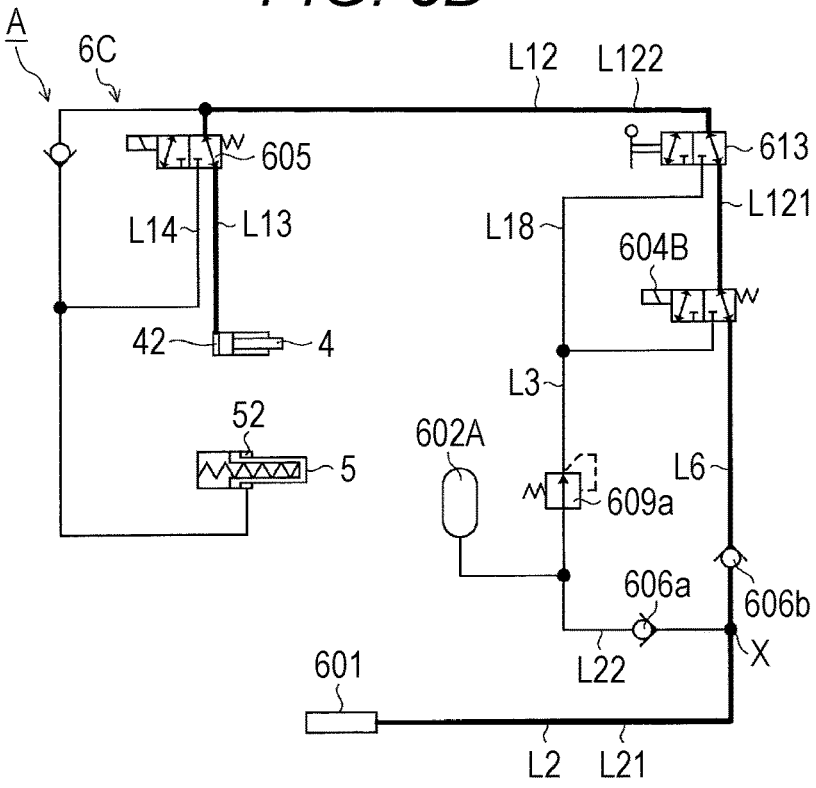
FIG. 5D is a diagram illustrating a state of the hydraulic circuit when the cylinder connection mechanism is transitioned to an engaged state in the crane according to the third embodiment.
Figure 5E:
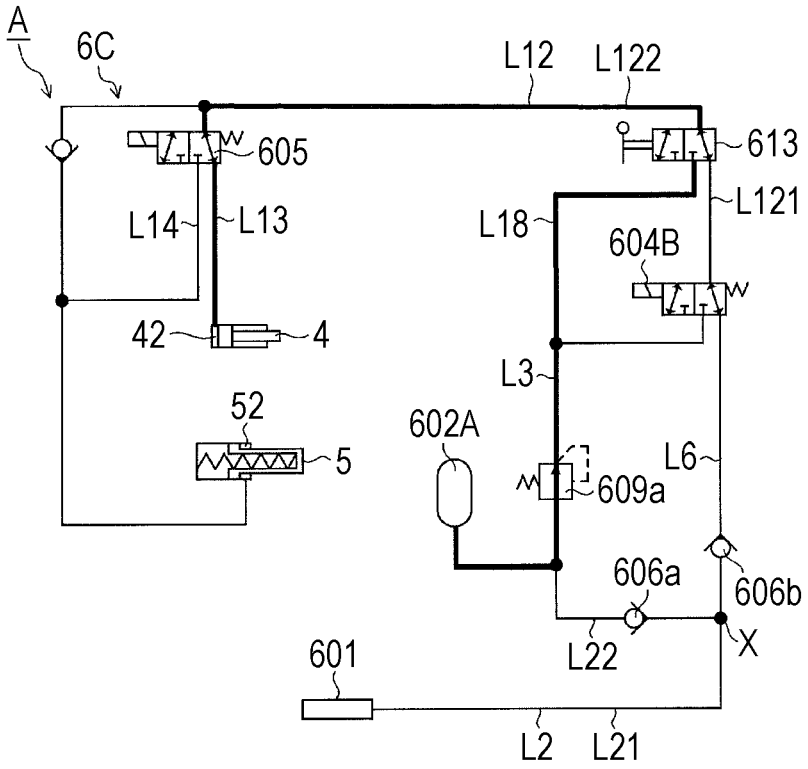
FIG. 5E is a diagram illustrating a state of the hydraulic circuit when the cylinder connection mechanism is transitioned to the disengaged state in an emergency in the crane according to the third embodiment.

Next, the operation of the hydraulic mechanism 6C will be described with reference to FIGS. 5A to 5E. FIG. 5A is a diagram for explaining the operation of the hydraulic mechanism 6C in performing the disengaging operation of the boom connection mechanism 5. FIG. 5B is a diagram for explaining the operation of the hydraulic mechanism 6C in performing the engaging operation of the boom connection mechanism 5. FIG. 5C is a diagram for explaining the operation of the hydraulic mechanism 6C in performing the disengaging operation of the cylinder connection mechanism 4. FIG. 5D is a diagram for explaining the operation of the hydraulic mechanism 6C in performing the engaging operation of the cylinder connection mechanism 4. FIG. 5E is a diagram for explaining the operation of the hydraulic mechanism 6C in performing the disengaging operation of the cylinder connection mechanism 4 in an emergency.

In the following description, it is assumed that the accumulator 602A has accumulated sufficient hydraulic oil to perform each of these operations.

Operation Example 3-1: Disengaging Operation of Boom Connection Mechanism

First, the operation of the hydraulic mechanism 6C in performing the disengaging operation of the boom connection mechanism 5 will be described with reference to FIG. 5A. Since the configuration of each member in the hydraulic mechanism 6C is as described above, any overlapping description will be omitted.

For example, if the operator instructs the disengaging operation of the boom connection mechanism 5 in the state in which the distal end boom element 141 and the intermediate boom element 142 are connected (see FIG. 2A), the first solenoid valve 604B and the second solenoid valve 605 become the energized state.

As a result, the first solenoid valve 604B and the second solenoid valve 605 become the first state. In this state, the emergency switching valve 613 is in the above-mentioned first state. Then, the hydraulic oil discharged from the accumulator 602A is supplied to the hydraulic chamber 52 of the boom connection mechanism 5 through the oil path illustrated by the thick solid line in FIG. 5A. The oil path illustrated by the thick solid line in FIG. 5A constitutes a feed oil path in the normal oil path.

Specifically, the hydraulic oil flows through the accumulator 602A, the oil path element L3, the first solenoid valve 604B, the oil path element L121, the emergency switching valve 613, the oil path element L122, the second solenoid valve 605, the oil path element L14, and the hydraulic chamber 52 of the boom connection mechanism 5 in this order.

As a result, the boom connection mechanism 5 transitions from the extension state to the contraction state, and the boom connection pins 51*a* are disengaged from the first boom pin receiving portions 142*b* (or the second boom pin receiving portions 142*c*) of the intermediate boom element 142. In this case, as an example, the boom connection pins 51*a* transition from the state illustrated in FIG. 2A to the state illustrated in FIG. 2B.

Operation Example 3-2: Engaging Operation of Boom Connection Mechanism

Next, the operation of the hydraulic mechanism 6C in performing the engaging operation of the boom connection mechanism 5 will be described with reference to FIG. 5B.

For example, if the operator instructs the engaging operation of the boom connection mechanism 5 in the state in which the distal end boom element 141 and the intermediate boom element 142 are not connected (see FIG. 2B), the second solenoid valve 605 becomes the energized state, whereas the first solenoid valve 604B becomes the non-energized state.

As a result, the second solenoid valve 605 becomes the first state, whereas the first solenoid valve 604B becomes the second state. Then, the hydraulic oil in the hydraulic chamber 52 of the boom connection mechanism 5 returns to the cylinder side hydraulic pressure source 601 through the oil path illustrated by the thick solid line in FIG. 5B. The oil path illustrated by the thick solid line in FIG. 5B constitutes a return oil path in the normal oil path.

Specifically, the hydraulic oil flows through the hydraulic chamber 52 of the boom connection mechanism 5, the oil path element L14, the second solenoid valve 605, the oil path element L122, the emergency switching valve 613, the oil path element L121, the first solenoid valve 604B, the oil path element L6, the upstream oil path element L21, and the cylinder side hydraulic pressure source 601 in this order.

As a result, the boom connection mechanism 5 transitions from the contraction state to the extension state, and the boom connection pins 51*a* are inserted across the boom pin receiving portions 141*b* of the distal end boom element 141 and the first boom pin receiving portions 142*b* or the second boom pin receiving portions 142*c* of the intermediate boom element 142. In this case, as an example, the boom connection pins 51*a* transition from the state illustrated in FIG. 2B to the state illustrated in FIG. 2A.

Operation Example 3-3: Disengaging Operation of Cylinder Connection Mechanism

Next, the operation of the hydraulic mechanism 6C in performing the disengaging operation of the cylinder connection mechanism 4 will be described with reference to FIG. 5C.

For example, if the operator instructs the disengaging operation of the cylinder connection mechanism 4 in the state of connection between the distal end boom element 141 and the cylinder member 32 as illustrated in FIG. 2D, the first solenoid valve 604B becomes the energized state, whereas the second solenoid valve 605 becomes the non-energized state.

As a result, the first solenoid valve 604B becomes the first state, whereas the second solenoid valve 605 becomes the second state. Then, the hydraulic oil discharged from the accumulator 602A is supplied to the hydraulic chamber 42 of the cylinder connection mechanism 4 through the oil path (also referred to as the first oil path) illustrated by the thick solid line in FIG. 5C. The oil path illustrated by the thick solid line in FIG. 5C constitutes a feed oil path in the normal oil path.

Specifically, the hydraulic oil flows through the accumulator 602A, the oil path element L3, the first solenoid valve 604B, the oil path element L121, the emergency switching valve 613, the oil path element L122, the second solenoid valve 605, the oil path element L13, and the hydraulic chamber 42 of the cylinder connection mechanism 4 in this order.

As a result, the cylinder connection mechanism 4 transitions from the extension state to the contraction state, and the pair of cylinder connection pins 41 are disengaged from the cylinder pin receiving portions 141*a* of the distal end boom element 141. In this case, as an example, the pair of cylinder connection pins 41 transition from the state illustrated in FIG. 2D to the state illustrated in FIG. 2E.

Operation Example 3-4: Engaging Operation of Cylinder Connection Mechanism

Next, the operation of the hydraulic mechanism 6C in performing the engaging operation of the cylinder connection mechanism 4 will be described with reference to FIG. 5D.

For example, if the operator instructs the engaging operation of the cylinder connection mechanism 4 in the state of non-connection between the distal end boom element 141 and the cylinder member 32 as illustrated in FIG. 2E, the first solenoid valve 604B and the second solenoid valve 605 become the non-energized state.

As a result, the first solenoid valve 604B and the second solenoid valve 605 become the second state. Then, the hydraulic oil in the hydraulic chamber 42 of the cylinder connection mechanism 4 returns to the cylinder side hydraulic pressure source 601 through the oil path illustrated by the thick solid line in FIG. 5D. The oil path illustrated by the thick solid line in FIG. 5D constitutes a return oil path in the normal oil path.

Specifically, the hydraulic oil flows through the hydraulic chamber 42 of the cylinder connection mechanism 4, the oil path element L13, the second solenoid valve 605, the oil path element L122, the emergency switching valve 613, the oil path element L121, the first solenoid valve 604B, the oil path element L6, the upstream oil path element L21, and the cylinder side hydraulic pressure source 601 in this order.

As a result, the cylinder connection mechanism 4 transitions from the contraction state to the extension state, and the pair of cylinder connection pins 41 are inserted into the cylinder pin receiving portions 141*a* of the distal end boom element 141. In this case, as an example, the pair of cylinder connection pins 41 transition from the state illustrated in FIG. 2E to the state illustrated in FIG. 2D.

Operation Example 3-5: Operation in Emergency

Next, the operation of the hydraulic mechanism 6C in performing the disengaging operation of the cylinder connection mechanism 4 in an emergency will be described with reference to FIG. 5E. In the present embodiment, the term "emergency" means a situation in which the first solenoid valve 604B and the second solenoid valve 605 cannot be energized and the switching of these valves cannot be performed.

For example, the operator switches the emergency switching valve 613 to the second state if the first solenoid valve 604B and the second solenoid valve 605 cannot be energized in the state of connection between the distal end boom element 141 and the cylinder member 32 as illustrated in FIG. 2D. In this operation, the operator makes the telescopic cylinder 3 contract to move the cylinder member 32 of the telescopic cylinder 3 to a position within the reach of the operator, for example. In this operation, the distal end boom element 141 moves together with the telescopic cylinder 3.

Then, after switching the emergency switching valve 613 to the second state, the operator instructs the disengaging operation of the cylinder connection mechanism 4 in an emergency through a predetermined operation (a switch operation, for example). Then, in response to the above-described instruction, the telescopic cylinder 3 transitions in the contraction direction. As a result, the hydraulic oil discharged from the accumulator 602A is supplied to the hydraulic chamber 42 of the cylinder connection mechanism 4 through the oil path (also referred to as the second oil path) illustrated by the thick solid line in FIG. 5E. The oil path illustrated by the thick solid line in FIG. 5E constitutes a feed oil path in the emergency oil path.

Specifically, the hydraulic oil flows through the accumulator 602A, the oil path element L3, the oil path element L18, the emergency switching valve 613, the oil path element L122, the second solenoid valve 605, the oil path element L13, and the hydraulic chamber 42 of the cylinder connection mechanism 4 in this order.

As a result, the cylinder connection mechanism 4 transitions from the extension state to the contraction state, and the pair of cylinder connection pins 41 are disengaged from the cylinder pin receiving portions 141*a* of the distal end boom element 141. In this case, as an example, the pair of cylinder connection pins 41 transition from the state illustrated in FIG. 2D to the state illustrated in FIG. 2E. Other configurations and actions/effects are the same as in the above-described first embodiment.

INDUSTRIAL APPLICABILITY

The crane according to the present invention is not limited to a rough terrain crane, and may be any of various types of mobile cranes such as an all-terrain crane, a truck cranes, and a truck loader crane (also referred to as a cargo crane). Furthermore, the crane according to the present invention is not limited to a mobile crane, and may be any other crane having a telescopic boom.

REFERENCE SIGNS LIST

1 Mobile crane
10 Traveling body
101 Wheel
11 Outrigger
12 Swivel base
14 Telescopic boom
141 Distal end boom element
141*a* Cylinder pin receiving portion
141*b* Boom pin receiving portion
142 Intermediate boom element
142*a* Cylinder pin receiving portion
142*b* First boom pin receiving portion
142*c* Second boom pin receiving portion
142*d* Third boom pin receiving portion
143 Base end boom element
15 Derricking cylinder
16 Wire rope
17 Hook
3 Telescopic cylinder
31 Rod member
32 Cylinder member
33 Contraction side hydraulic chamber
34 Extension side hydraulic chamber
4 Cylinder connection mechanism
41 Cylinder connection pin
42 Hydraulic chamber
5 Boom connection mechanism
51*a* Boom connection pin
51*b* Boom connection pin
52 Hydraulic chamber
A Actuator
6, 6B, 6C Hydraulic mechanism
601 Cylinder side hydraulic pressure source
601*a* Counterbalance valve
602A Accumulator
603 Hydraulic pressure switching mechanism
603*a* Hydraulic pressure switching valve
603*b* Pilot solenoid valve
604, 604B First solenoid valve
605 Second solenoid valve
606*a*, 606*b*, 606*d* Check valve
609*a*, 609*b* Pressure reducing valve
610*c* Relief valve
611 Emergency switching mechanism
612 Cock
613 Emergency switching valve
L1*a*, L1*b*, L1*c*, L121, L122, L2 to L14, L17, L18, L171 to L173 Oil path element
L21 Upstream oil path element
L22 Downstream oil path element
X Branch point

The invention claimed is:

1. A crane comprising:
a telescopic boom that is capable of being extended;
an extension device for extending the telescopic boom;
a hydraulic pressure source provided in the extension device;
a cylinder connection mechanism connected to the hydraulic pressure source and switching between states of connection and non-connection with the telescopic boom based on supply and discharge of hydraulic oil;
a first oil path for connecting the hydraulic pressure source and the cylinder connection mechanism;
a first valve that is provided on the first oil path and switches a supply and discharge state of the hydraulic oil with respect to the cylinder connection mechanism; and
a second oil path that bypasses the first valve and connects the hydraulic pressure source and the cylinder connection mechanism.

2. The crane according to claim 1, wherein the hydraulic pressure source is a hydraulic cylinder constituting the extension device.

3. The crane according to claim 2, wherein the hydraulic pressure source includes the hydraulic cylinder and an accumulator connected to the hydraulic cylinder,
the first oil path connects the accumulator and the cylinder connection mechanism, and
the second oil path connects the hydraulic cylinder and the cylinder connection mechanism.

4. The crane according to claim 1, wherein the hydraulic pressure source is an accumulator provided in the extension device.

5. The crane according to claim 1, further comprising a second valve that is capable of switching between a state in which the hydraulic pressure source and the cylinder connection mechanism are communicated through the first oil path and a state in which the hydraulic pressure source and the cylinder connection mechanism are communicated via the second oil path.

6. The crane according to claim 5, further comprising a third valve that is capable of switching between a state in which a pilot pressure is supplied to the second valve and a state in which the pilot pressure is not supplied to the second valve in response to the energization, and when the third valve switches to the state in which the pilot pressure is not supplied, the second valve becomes a state in which the hydraulic pressure source and the cylinder connection mechanism are communicated through the second oil path.

7. The crane according to claim 1, wherein the second oil path includes a relief valve that, when a pressure equal to or higher than a predetermined value is applied thereto, communicates the hydraulic pressure source and the cylinder connection mechanism.

8. The crane according to claim 1, wherein the second oil path includes a manual switching valve for manually switching between a state in which the hydraulic pressure source and the cylinder connection mechanism are communicated and a state in which the hydraulic pressure source and the cylinder connection mechanism are disconnected.

* * * * *